US011619010B2

(12) United States Patent
Guinn et al.

(10) Patent No.: US 11,619,010 B2
(45) Date of Patent: Apr. 4, 2023

(54) ROLLER TUBE CONCRETE PAVER WITH RETRACTABLE VIBRATOR ASSEMBLY

(71) Applicant: Allen Engineering Corporation, Paragould, AR (US)

(72) Inventors: Timmy D. Guinn, Paragould, AR (US); J. Dewayne Allen, Paragould, AR (US)

(73) Assignee: Allen Engineering Corporation, Paragould, AR (US)

( * ) Notice: Subject to any disclaimer, the term of this patent is extended or adjusted under 35 U.S.C. 154(b) by 695 days.

(21) Appl. No.: 16/740,945

(22) Filed: Jan. 13, 2020

(65) Prior Publication Data

US 2020/0232168 A1 Jul. 23, 2020

Related U.S. Application Data

(60) Provisional application No. 62/793,697, filed on Jan. 17, 2019.

(51) Int. Cl.
*E01C 19/41* (2006.01)
*B06B 1/18* (2006.01)

(52) U.S. Cl.
CPC ..... *E01C 19/41* (2013.01); *B06B 1/183* (2013.01)

(58) Field of Classification Search
CPC ..... B06B 1/183; E01C 19/41; E01C 19/22; E01C 19/002; E01C 19/48
See application file for complete search history.

(56) References Cited

U.S. PATENT DOCUMENTS 2,148,214 A * 2/1939 Mall ..... E01C 19/407 404/116
2,248,103 A * 7/1941 Mall ..... E01C 19/407 404/116
4,128,359 A * 12/1978 Cooper, Jr ..... E01C 19/407 404/116
4,314,773 A * 2/1982 Allen ..... E01D 21/00 425/219
4,702,640 A 10/1987 Allen
4,964,754 A * 10/1990 Garner ..... E01C 19/29 404/125
5,492,432 A * 2/1996 Eben ..... E01C 19/40 404/115

(Continued)

*Primary Examiner* — Abigail A Risic
(74) *Attorney, Agent, or Firm* — Stephen D. Carver

(57) ABSTRACT

A roller tube concrete finishing machine includes retractable vibration gangs that can be selectively immersed within wet concrete and then retracted with parallelogram linkage. Spaced-apart, drive parallel rollers are journaled between frame ends for supporting and propelling the machine upon and between parallel form rails. A front roller provide a strike-off function. The vibration gangs are deployed by a retractable, parallelogram linkage that moves them forwardly and downwardly for operation, or which retracts the vibrators inwardly and upwardly relative to the frame. When the vibrators are retracted, the are withdrawn upwardly from the concrete and retracted rearwardly towards the machine front to reduce machine dimensions. Substantial retraction of the vibrators prevents subsequent interference with the rebar below. Vibrator retraction reduces overall machine dimensions for clearance and shipping purposes, with gang vibration arrays nested upwardly and inwardly proximate the front of the machine.

11 Claims, 23 Drawing Sheets

(56) References Cited

U.S. PATENT DOCUMENTS

| | | | | |
|---|---|---|---|---|
| 5,562,361 | A * | 10/1996 | Allen | E01C 19/26<br>425/62 |
| 5,988,939 | A | 11/1999 | Allen | |
| 6,234,713 | B1 * | 5/2001 | Rowe | E01C 19/29<br>404/116 |
| 9,028,168 | B1 * | 5/2015 | Knapp | E01C 7/00<br>404/85 |
| 9,476,169 | B1 * | 10/2016 | Knapp | E01C 19/407 |
| 10,132,047 | B2 * | 11/2018 | Terstriep | E01C 19/40 |
| 10,190,268 | B2 * | 1/2019 | Pietila | E01C 19/006 |

* cited by examiner

ROLLER TUBE CONCRETE PAVER WITH RETRACTABLE VIBRATOR ASSEMBLY

CROSS REFERENCE TO RELATED APPLICATION

This utility conversion patent application is based upon, and claims priority from, previously filed U.S. Provisional Patent Application Ser. No. 62/793,697, filed 17 Jan. 2019, entitled "Roller Tube Concrete Paver with Retractable Vibrator Assembly" by inventors Timmy D. Guinn (American Citizen) and J. Dewayne Allen (American Citizen), which is incorporated by reference herein.

BACKGROUND OF THE INVENTION

I. Field of the Invention

The present invention relates generally to motorized screeds, finishers, or pavers for compacting and densifying wet concrete with one or more powered, rotatable roller tubes. More particularly, the present invention relates to multiple-roller, concrete finishing machines that include several mechanical vibrators that can be selectively switched between immersed positions within wet concrete or withdrawn, clearance positions enabling machine displacement. Known prior art germane to this invention can be found in CPS Class E01C, Subclasses 19/22, 19/26, 19/29, and 19/38, and in U.S.P.C. Class 404, Subclasses 103, 114, 116, 117, 122 and 125.

II. Description of the Prior Art

It is well recognized in the art that wet or plastic concrete must be processed or finished soon after pouring and before significant hardening to achieve the desired, smooth and even surface. Wet concrete is normally discharged from above, and poured between a pair of spaced-apart forms or "rails" that may border and traverse a region to be paved, such as bridge decks and the like. Usually wet concrete is poured immediately in front of a concrete finishing machine that may be supported by concrete forms that function as supporting guide rails for the machinery.

A variety of finishing devices such as strike-offs, screeds, vibrating screeds, and roller screeds or pavers, with one or more rotating rollers, and perhaps one counter-rotating roller, are known in the art. Various propulsion means may be employed for machine displacement over the rails for travel along the deck length. Common roller-type finishing screeds or pavers achieve propulsion through the rotation of one or more of their elongated roller tubes, that support and displace the machine over the form rails, while concurrently contacting, spreading and surfacing the concrete below.

Notwithstanding all of the advantages characterizing modern roller pavers or roller screeds, it remains necessary to vigorously vibrate the concrete to facilitate desirable concrete consolidation. Bridge deck specifications, for example, may require significant concrete vibration at numerous different deck locations for various time intervals. Thus, as discussed below, many prior art roller pavers or screeds include some form of concurrently operated vibration means. However, the relatively extensive placement of rebar and other reinforcing rods or structures below the pour complicates the vibration process for settling and consolidating the concrete. The vibrators are not permitted to destructively contact the rebar.

As a result, typical vibrators are vertically oriented to facilitate non-obstructive movements between a lower, concrete immersion position, and an elevated or withdrawn clearance position. Since concrete hardens very quickly, the concrete must be vibrated proximate the forward end of the concrete finishing machine so that the roller machine has ample time to contact the surface before concrete hardening. If concrete is vibrated too far ahead of the finishing machine, premature hardening may denigrate subsequent finishing as the machine slowly traverses the rails and reaches some of the concrete too late. Thus the vibration assembly is typically mounted as close as possible to the machine frame and its lower roller tubes so that the time travel between vibrated concrete and roller-contact is minimized.

Prior art concrete finishing devices for settling and densifying wet concrete, including roller tube machines and the like, may include a variety of different vibration devices or assemblies. Vibrator gangs, that may comprise pluralities of electric, electro-mechanical, pneumatic and/or hydraulic vibrators are known in the art.

A prior art roller tube concrete finishing machine characterized by some of the above characteristics is seen in U.S. Pat. No. 4,128,359 issued Dec. 5, 1978. Disclosed is a self-propelled concrete vibrator machine supported upon a pair of spaced-apart guide rails proximate a bridge deck. Rotating finishing tubes supported between elements of an elongated truss assembly contact the upper concrete surface. A plurality of vertically displaceable and horizontally spaced-apart hydraulic vibrators are mounted on the rearward end of the truss assembly. The hydraulic vibrators are vertically movable into or out of the concrete. The vibrators are moved along the guide rails closely adjacent the forward end of the finishing machine so that the concrete may be vibrated at predetermined spacings for predetermined lengths of time immediately prior to the concrete being finished by the finishing machine.

U.S. Pat. No. 4,314,773 issued Feb. 9, 1982 and owned by the present assignee, Allen Engineering Corporation, discloses a form-riding, concrete placement and finishing machine comprising multiple roller tubes that treat the lower concrete surface. One or more of the rollers can provide propulsion. The moving rollers are positioned above an area into which wet concrete has been poured, for vibrating the concrete mass to promote densification and for finishing the concrete surface. The machine comprises an elongated, structural bridge terminating in opposite ends between which multiple, parallel rollers are journaled. A pair of rollers contact the form rails bordering the wet concrete, supporting the machine as it is longitudinally translated over the wet concrete below. A plurality of immersible, vibrator units are coupled at spaced apart intervals along one side of the machine, projecting in a generally vertical orientation. A machine subframe is vertically displaceable between first and second positions to either immerse the vibrator units within wet concrete, or to withdraw them from the concrete, enabling subsequent machine movement over the concrete without interference with submersed rebar.

U.S. Pat. No. 4,702,640 issued Oct. 27, 1987, and also owned by Allen Engineering Corporation, discloses another rotating-tube type concrete finisher. This motor-powered machine comprises a single roller that can be operated by one workman. A pair of end handle assemblies coupled to opposing ends of a cylindrical finishing roller and operated to selectively drive the finishing roller either forward or reverse directions.

U.S. Pat. No. 5,562,361 issued to Allen Engineering Corporation on Oct. 8, 1996 discloses a powered, form-riding, concrete finisher that uses a trio of roller tubes to strike-off, screed and finish concrete. A box-like, generally parallelepiped, frame houses an engine and a hydraulic system powered by the engine that rotates at least two of the rollers for propulsion. A front strike-off roller that is normally positioned somewhat higher than the propulsion rollers contacts and strikes off the slab surface first. The two driven rollers provide locomotion to the machine while simultaneously screeding and finishing concrete the machine moves over. These drive rollers are bidirectional to facilitate forward and rearward movements. The strike-off roller tube preferably rotates counter to the drive rollers to help grade and displace excess unlevel concrete.

The concrete finishing machine disclosed in U.S. Pat. No. 9,476,169 issued Oct. 25, 2016 comprises a roller-type finisher or screed that is driven by a motor mounted in the tube forming the roller. The roller support and attached screed roller pivot between a stowed position extending along a side of the loader, generally parallel to the direction of travel, and an extended position in which the roller support and screed roller extend up to approximately ninety degrees to the side of the loader.

Thus a plurality of prior art roller screeds or pavers exist. However, a variety of vibrating structures are employed with them, mostly involving a plurality of vertical vibrators that are moved up and down, as needed, between immersed and clearance positions. However, banks of vertically displaceable vibrators, with their various mechanical linkages, accessory hydraulic hoses, and various connections, are bulky and cumbersome. Usually, as is the case with the Allen Engineering Corporation triple roller tube paver or finisher of U.S. Pat. No. 5,562,361, the vibration section must be removed from the finishing machine and shipped or transported separately from the finishing machine. The assembled finishing machine, with-the vibration section secured, is too large and bulky to fit within conventional containers or to fit within the confines of standard trucking shipping volumes. Even with the vibrating section removed, the machine just barely fits within the dimensions of legal shipping spaces upon flatbed trucks, or within shipping containers. With the main and vibrating sections shipped separately, upon arrival at the customer's destination, somewhat complex assembly must be completed on site, adding a degree of inconvenience, with a concomitant time delay experienced by the customer. Then, each time the customer moves his or her finishing equipment to a distant job site, these bulkiness and shipping problems add further aggravation and delay.

Therefore we have designed a roller tube paver assembly with a retractable vibrator assembly that can be switched between retracted shipping positions, and a larger dimensioned concrete vibrating position wherein the multiple vibrators are immersed within concrete. The retractable vibration assembly is suitable for use with a variety of concrete finishing machines, such as multi-roller tube pavers, or powered concrete finishers, strike-offs or screeds of the character suggested.

SUMMARY OF THE INVENTION

A concrete finishing machine includes a retractable vibration section that includes a plurality of vibrators that can be selectively immersed within or withdrawn from wet concrete without requiring assembly or disassembly. A preferred finishing machine equipped with the retractable vibration assembly comprises multiple spaced-apart, parallel rollers that are supported by and extend between parallel form rails.

The preferably hydraulically operated vibration section comprises gangs of vibrators mounted through appropriate supports and operated by a retractable, compound movement linkage secured to the machine frame. When the compound movement linkage is deployed, the generally vertically oriented vibrators are displaced downwardly and vertically into the mass of green concrete below the machine. When the vibrator section is retracted by the linkage, the vibrators are withdrawn upwardly from the concrete and retracted towards the machine frame. Preferably the compound movement linkage is in the form of a parallelogram linkage. Substantial retraction of the vibrators prevents subsequent interference with the rebar below. Then, as the vibration section further retracts, outside overall machine dimensions are reduced for clearance purposes, as the gang vibration arrays are nested upwardly and inwardly proximate the front of the machine, maximizing machine clearance, and minimizing machine dimensions. With the finishing machine dimensions so reduced, bulkiness is reduced, and shipping, handling and transportation issues are eased.

In other words, the overall external dimensions of the finishing machine can be selectively reduced by retracting the vibration section, thus easing clearance problems, and making shipping and stowage easier, safer, and faster.

Thus, it is a basic object of the present invention to provide a self-propelled concrete finishing machine equipped with a retractable vibration section that, when retracted, reduces the external dimensions of the machine.

Another basic object is to provide a machine of the character described that employs a plurality of roller tubes with one or more separate, retractable vibration sections executing compound movements.

It is also an object to provide a roller tube finishing machine of the character described that strikes-off excess, unlevel concrete adjacent the leading edge of the machine while screeding and finishing concrete that the machine moves over, and which provides selectable vibration.

Another basic object of the present invention is to use a self-propelled, form riding finishing machine including one or more deployable vibration sections that can selectively engage and vibrate wet concrete, but which selectively retract to withdraw vibrators from the concrete to reduce interference with rebar and concurrently reduce external machine dimensions.

Another important object of the present invention is to provide a concrete finishing machine of the character described that can be shipped to a customer as a single unit.

A related object is to provide a concrete finishing machine whose vibration section(s) may be selectively retracted into a compact orientation such that the machine assumes reduced overall, external dimensions A related object is to provide a concrete finishing machine of the character described that does not require partial customer assembly when delivered.

A corollary object is to obviate the need for partial machine disassembly prior to customer or operator transport between job sites.

A still further object of the invention is to provide a self-propelled concrete finishing machine including a truss assembly extending between spaced-apart roller drive units, to which a retractable vibrator assembly may be coupled.

A still further object of the invention is to provide a vibrator section adapted to be removably coupled to a concrete finisher machine.

It is also an object to provide a machine of the character described with an access platform for operator convenience and safety.

Another object is to provide a roller tube concrete finishing machine of the character described with an operator console inside of the main frame, enabling the operator to easily control machine functions, and to easily observe machine travel.

Yet another object of our invention is to provide a roller screed or paver of the character described that has adjustable frame sections that facilitate frame deflection adjustments.

These and other objects and advantages will appear or become apparent in the course of the following descriptive sections.

BRIEF DESCRIPTION OF THE SEVERAL VIEWS OF THE DRAWINGS

In the following drawings, which form a part of the specification and which are to be construed in conjunction therewith, and in which like reference numerals have been employed throughout wherever possible to indicate like parts in the various views.

DETAILED DESCRIPTION OF THE PREFERRED EMBODIMENTS

As a preliminary matter it is be noted that, as used herein, the terms "screed," "paver," "tube finisher", "roller finisher", "roller tube finisher" and/or "tube screed" or "tube paver" are used interchangeably to refer to concrete finishing machines that accomplish concrete finishing, and/or paving and/or screeding effects with one or more spaced-apart roller tubes supported upon forms.

Further, the basic machine frame, simple motive portions of this invention including hydraulics, and the basic roller tube system, are generally described and illustrated in prior U.S. Pat. No. 5,562,361, which, for purposes of disclosure, is incorporated by reference herein as if fully set forth and described in detail.

Figure 1:
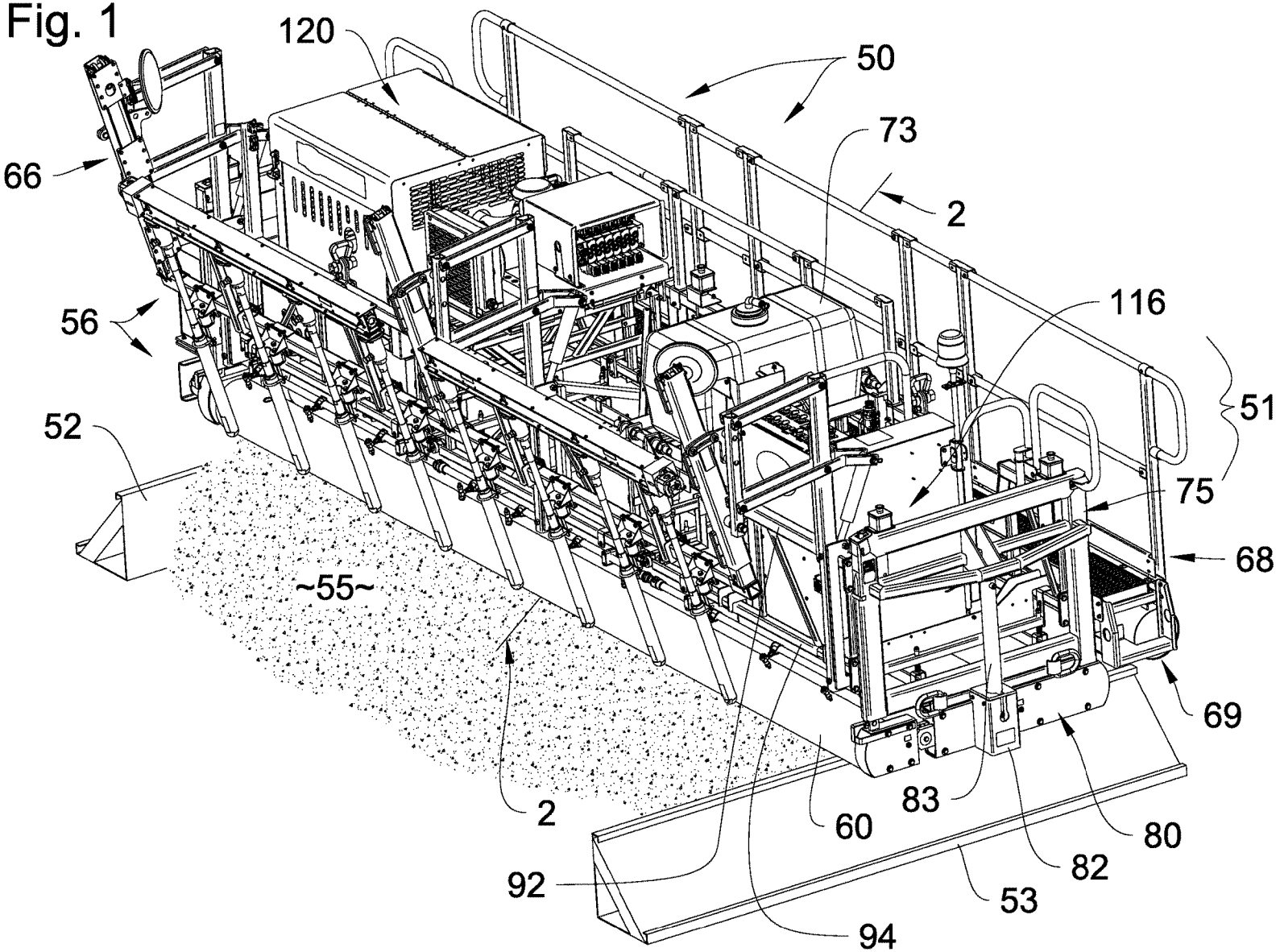
FIG. 1 is a fragmentary, left frontal isometric of our new concrete finishing machine, showing it disposed upon suitable conventional forms proximate concrete to be treated.
Figure 2:
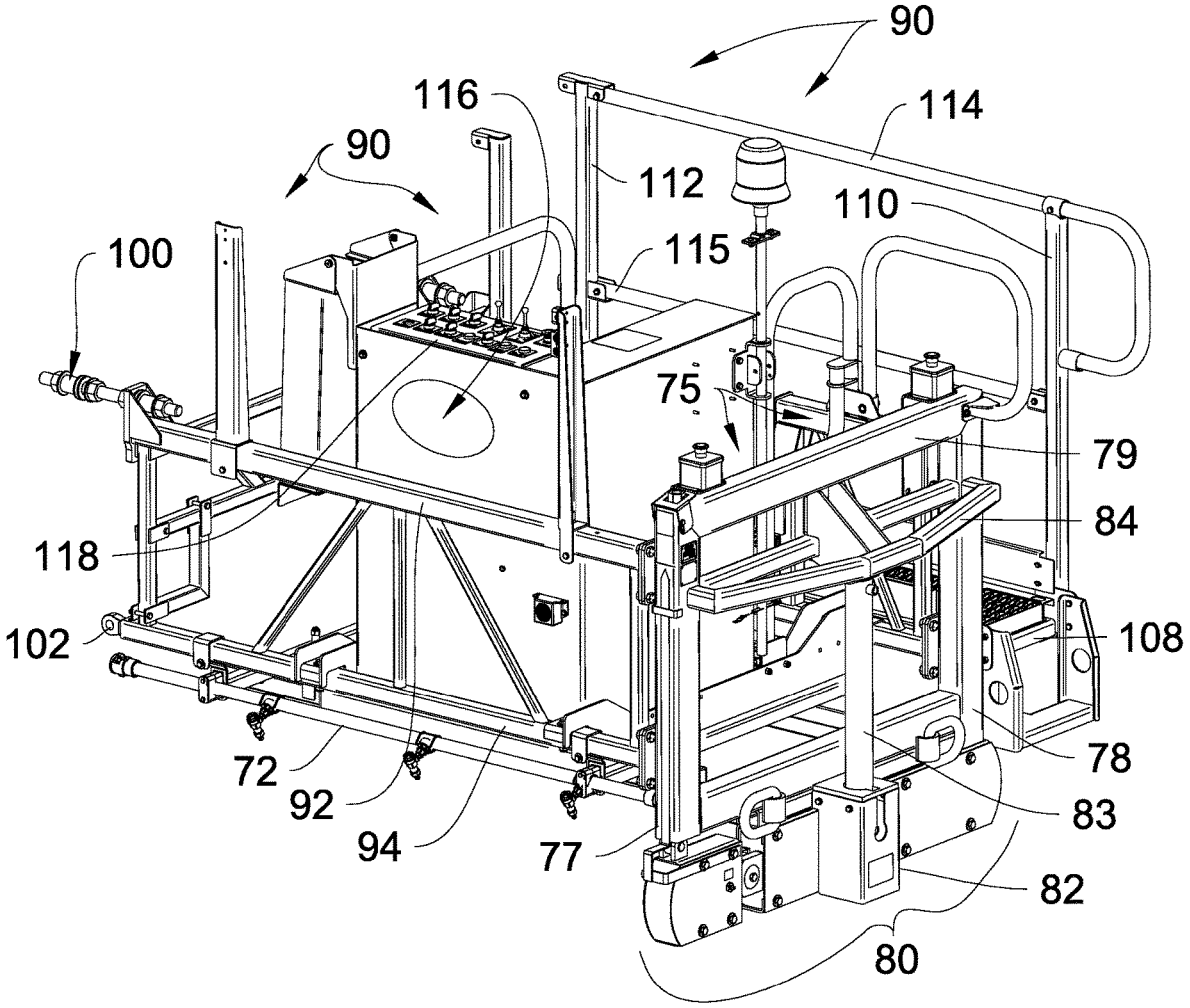
FIG. 2 is an enlarged, fragmentary isometric view showing an operator end frame section.
Figure 3:
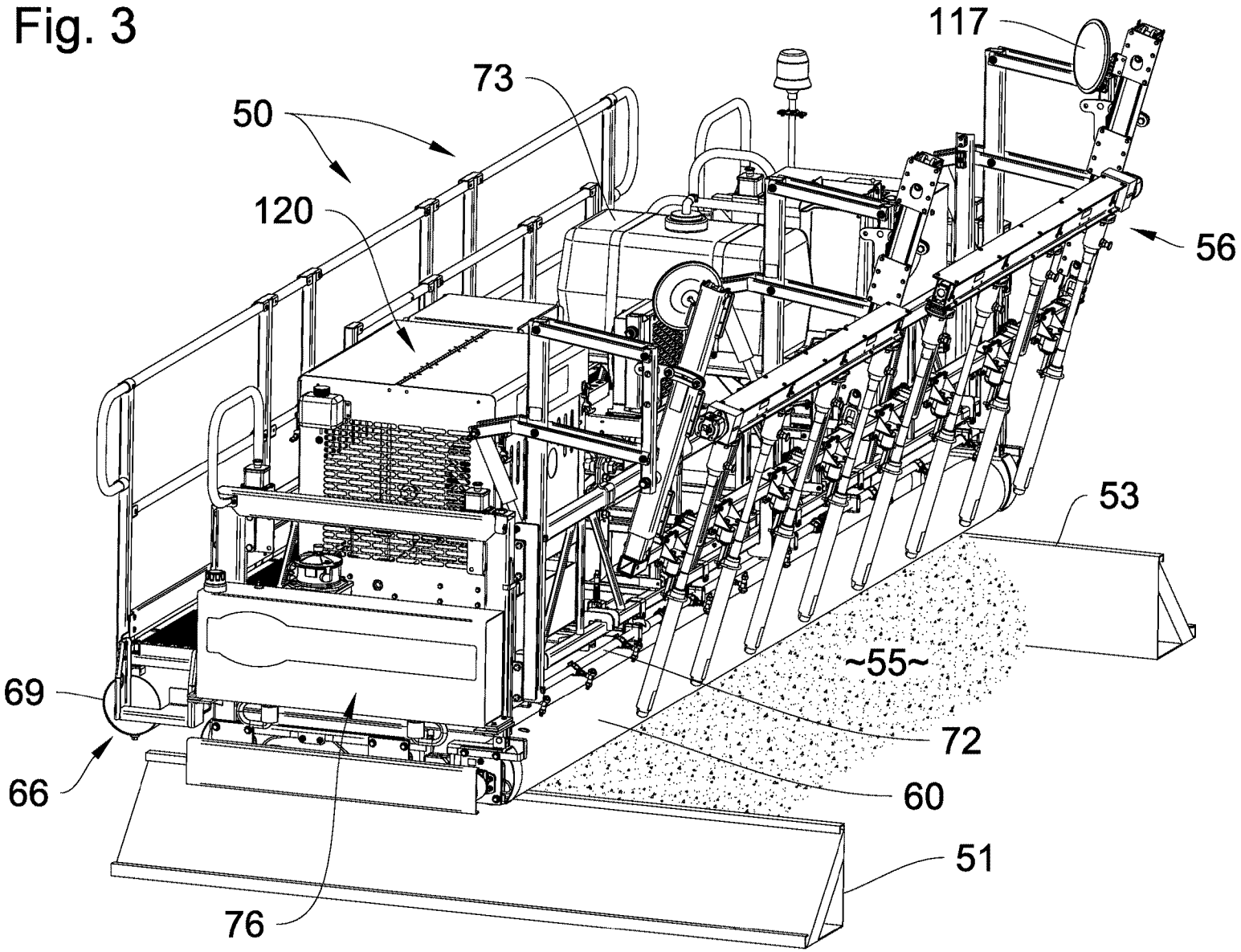
FIG. 3 is a fragmentary, right frontal isometric of our new concrete finishing machine.
Figure 4:
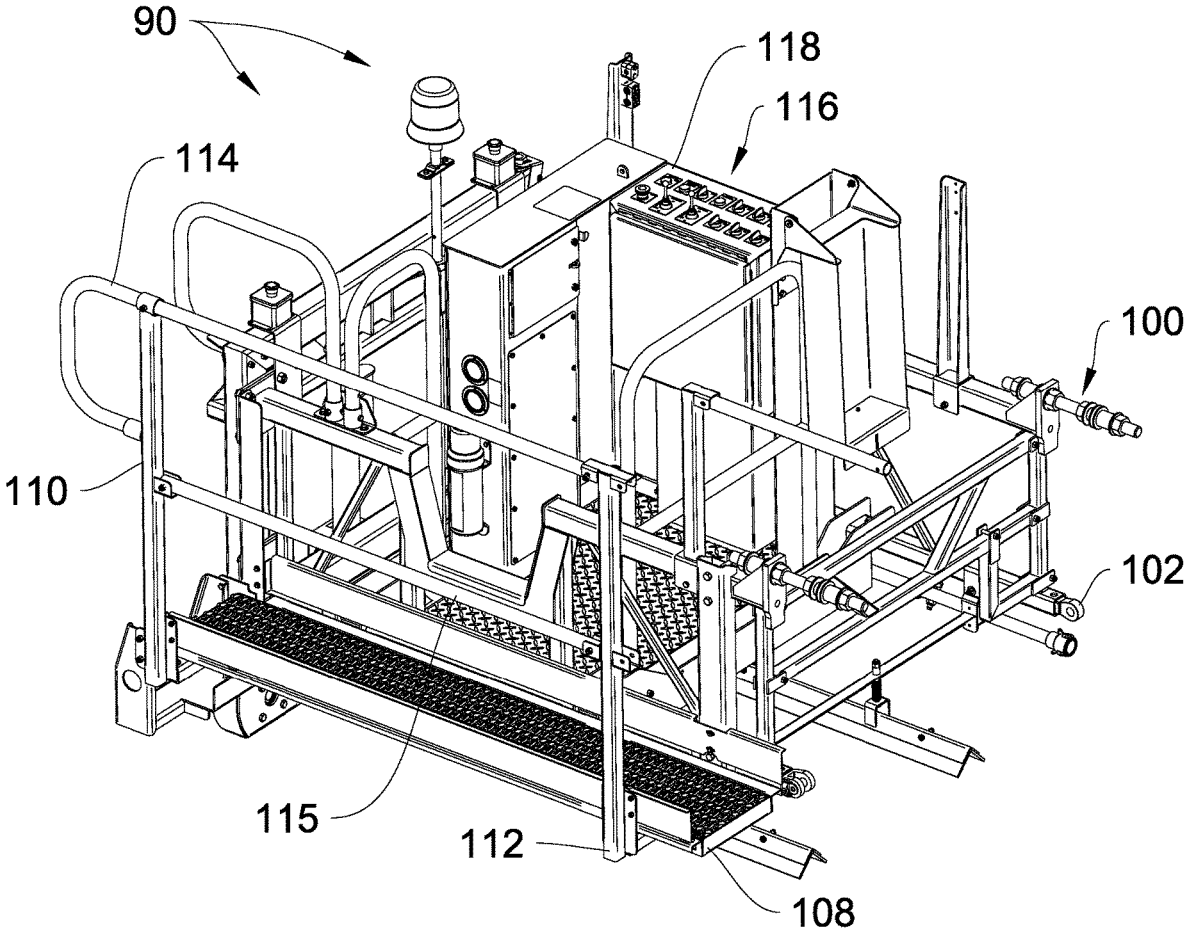
FIG. 4 is an enlarged, fragmentary isometric view of the preferred operator console position taken generally from a position to the left of FIG. 3.
Figure 5:
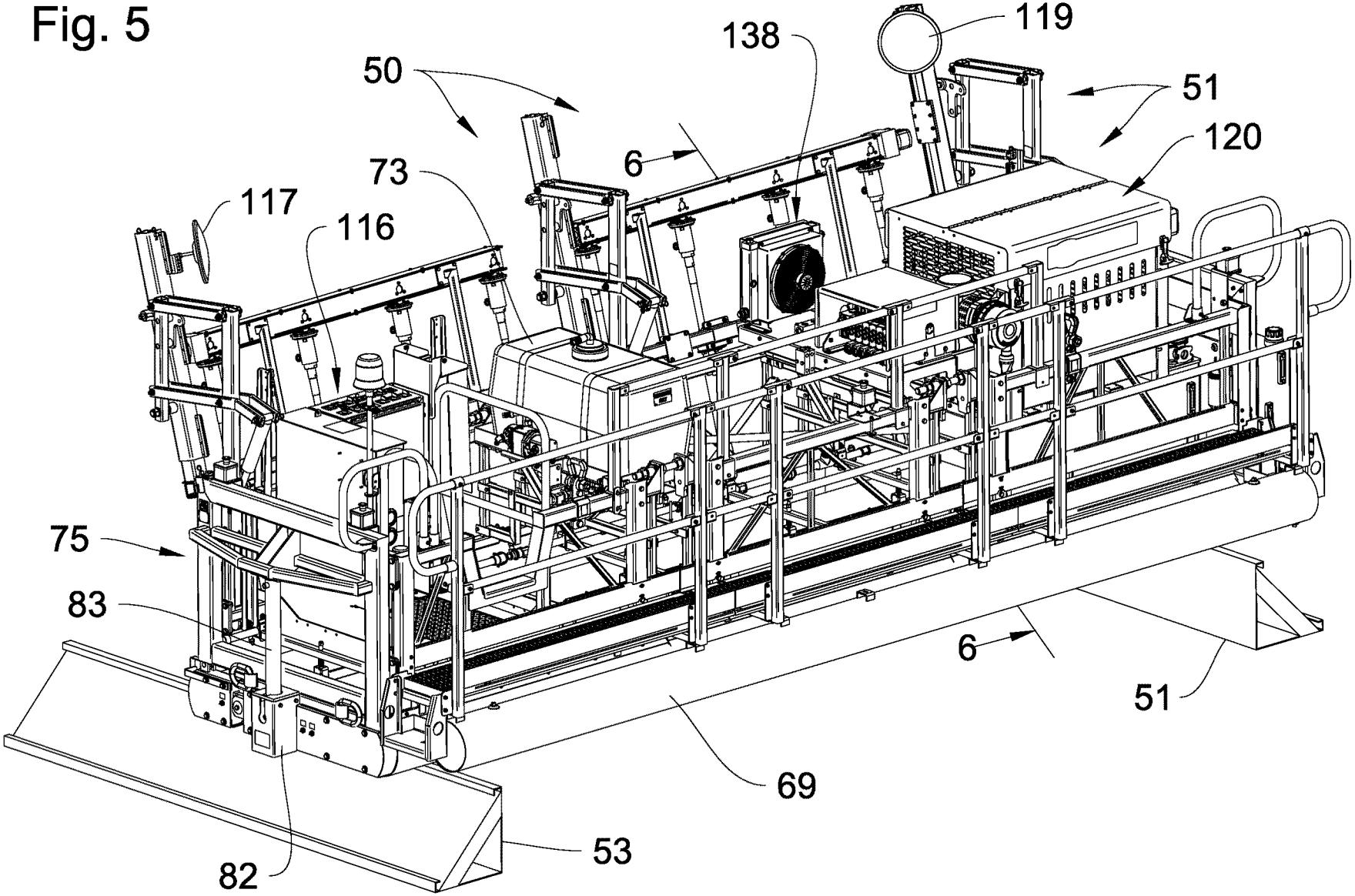
FIG. 5 is a fragmentary, left rear isometric of our new concrete finishing machine.
Figure 6:
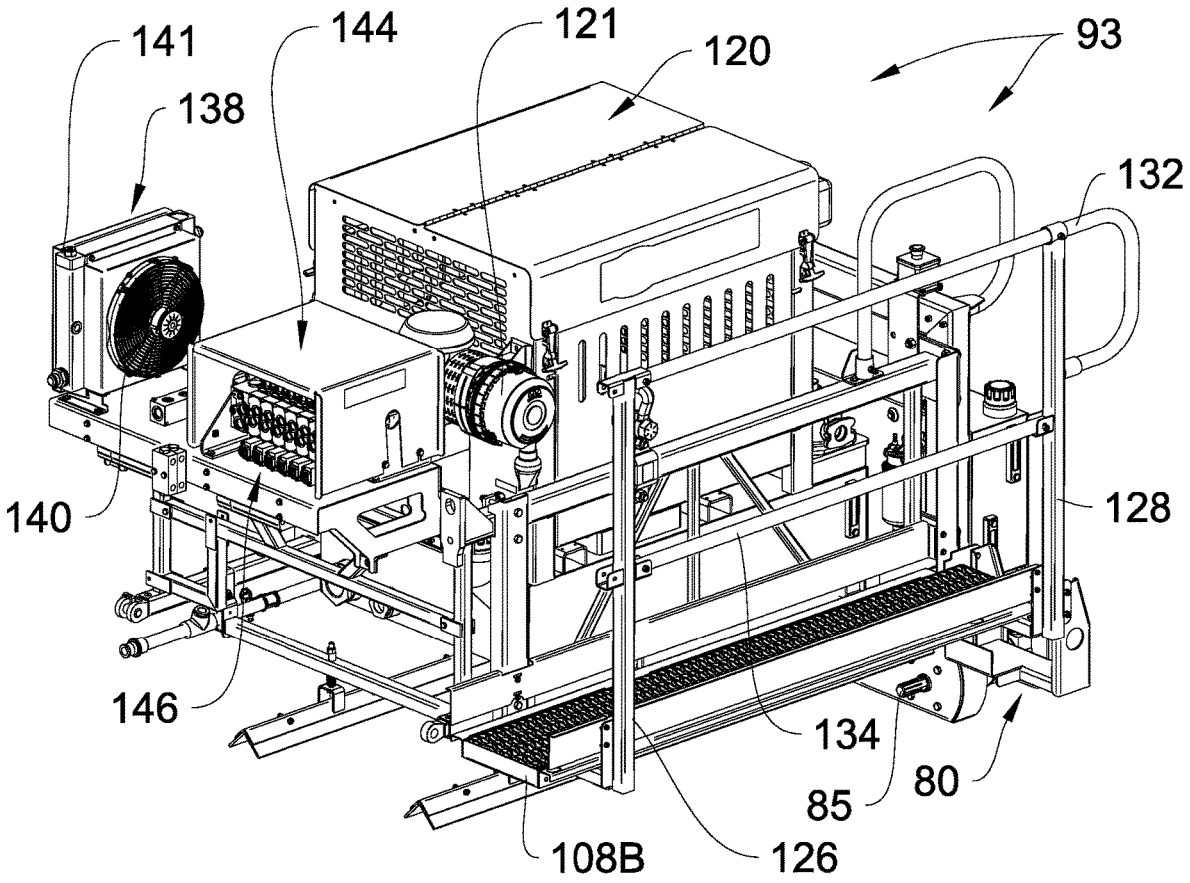
FIG. 6 is an enlarged, fragmentary isometric view generated along line 6-6 of FIG. 5.
Figure 7:
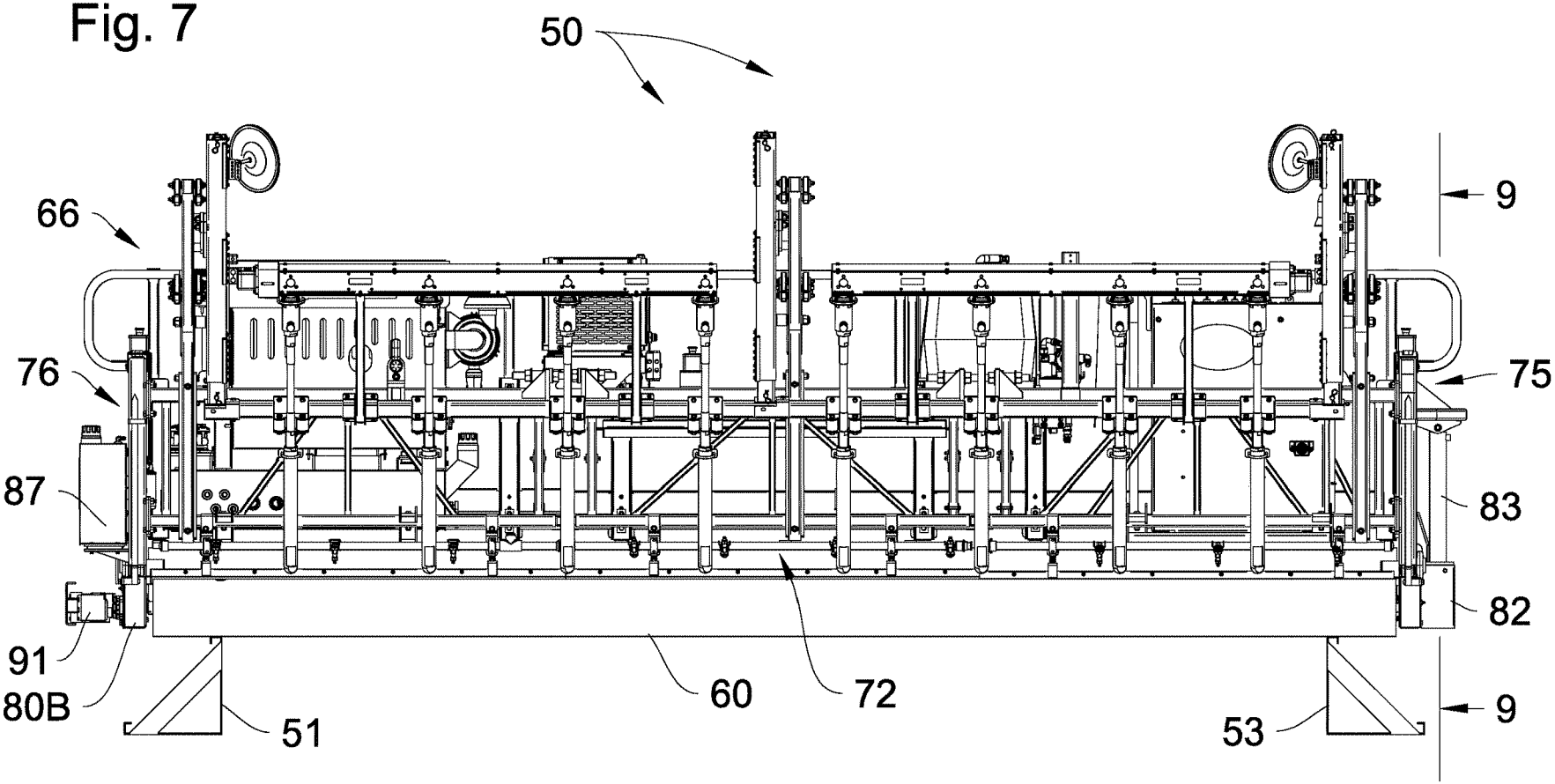
FIG. 7 is a front plan view thereof.
Figure 8:
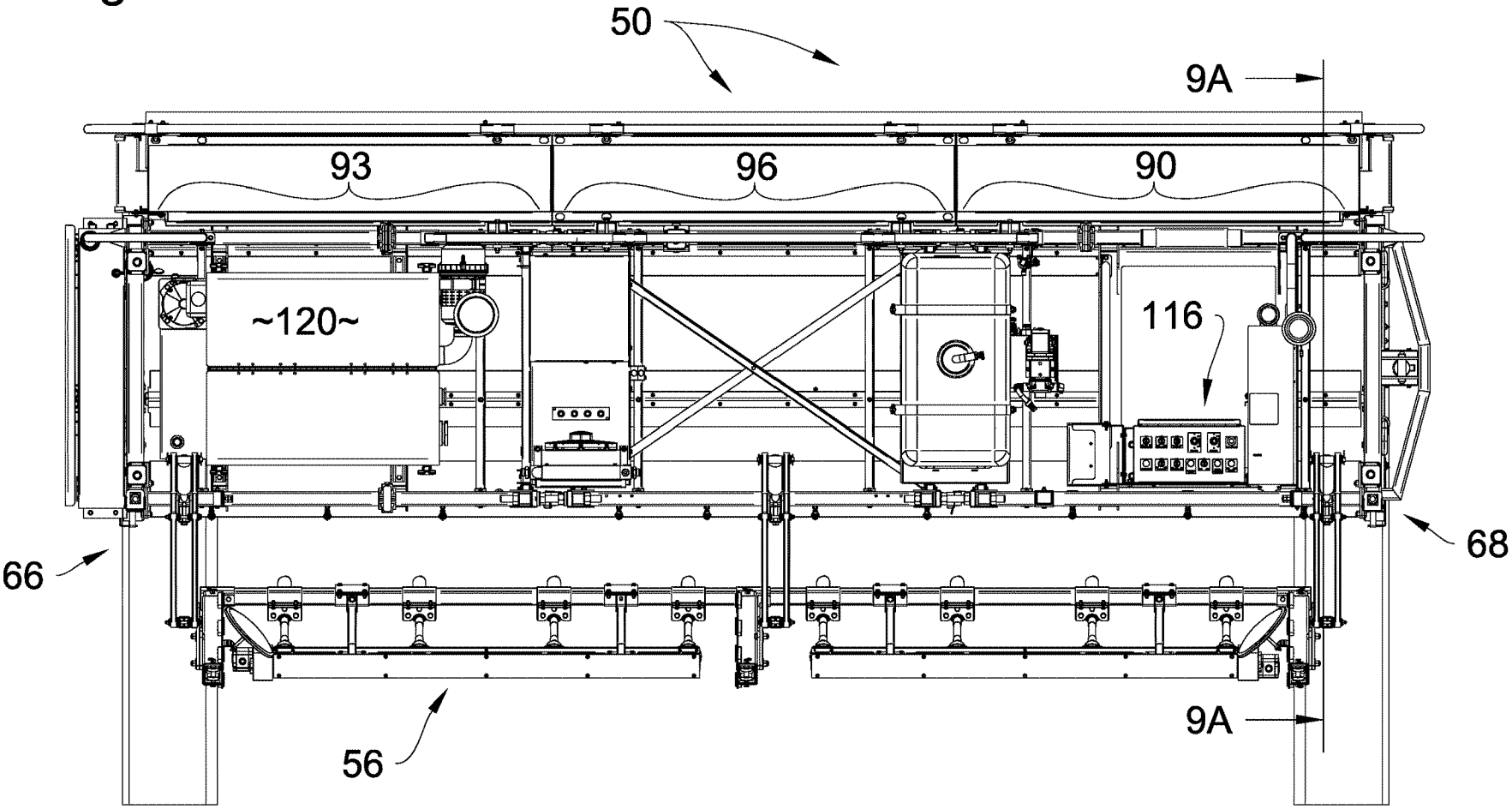
FIG. 8 is a top plan view thereof.
Figure 9:
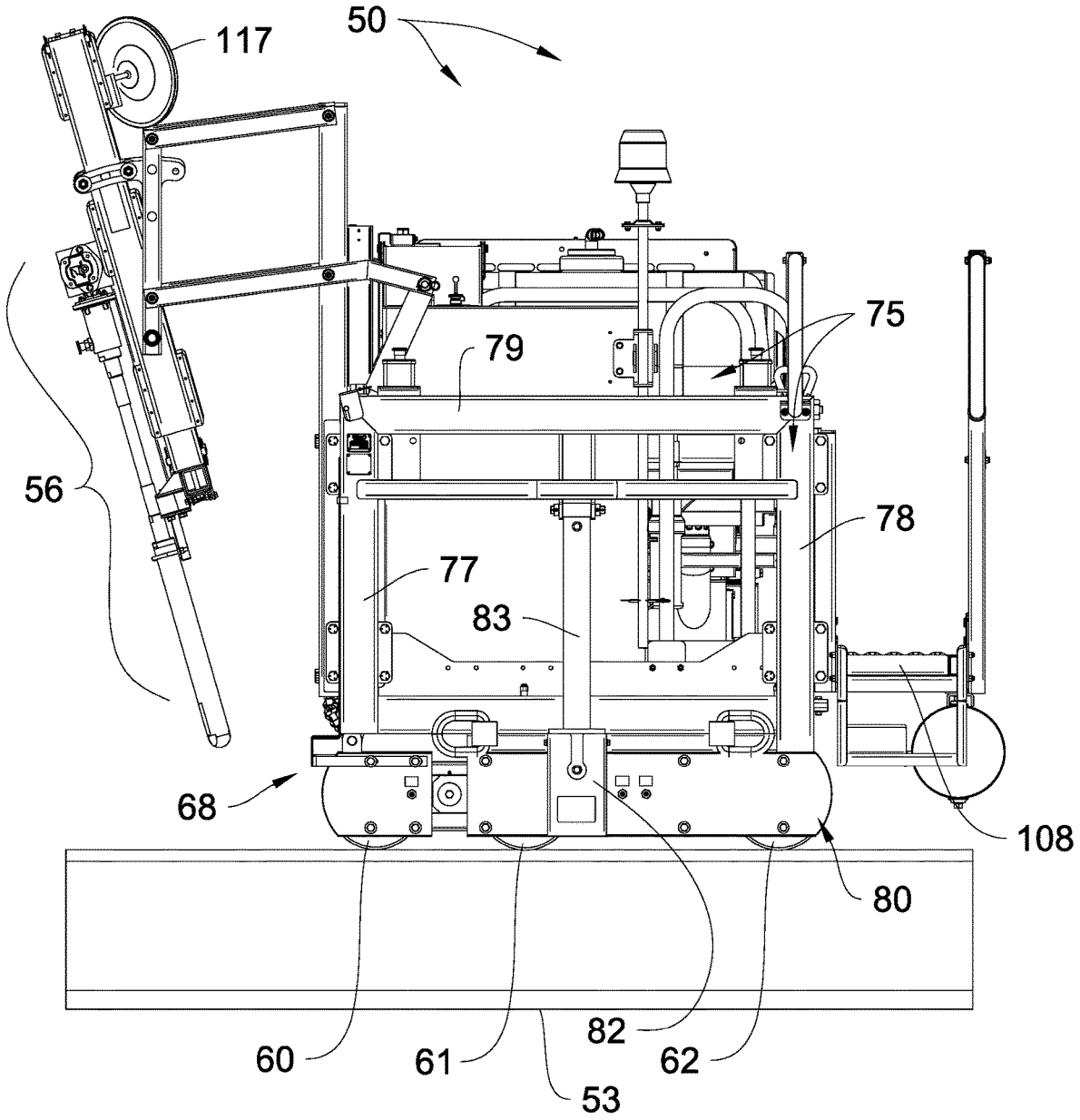
FIG. 9 is an enlarged, left end elevational view taken generally along line 9-9 of FIG. 7.

With reference now directed generally to FIGS. 1-9 of the appended drawings, a concrete finishing machine constructed in accordance with the best mode of the invention known at this time has been generally designated by the reference numeral 50. The machine frame has been generally designated by the reference numeral 51. The preferred finishing machine 50 is of the roller type, comprising a plurality of roller tubes 60-62 that rest upon and extend between conventional forms 52, 53 that confine a mass of wet concrete forming a slab 55 that is to be treated prior to hardening. The three, elongated and parallel roller tubes 60, 61 and 62 (i.e., FIG. 9A) are journaled for rotation and mounted beneath the machine frame 51, extending from the right end 66 (i.e., FIGS. 3, 7) of the machine 50 to the left end 68 (FIGS. 1, 9). Preferably only roller tubes 61 and 62 provide propulsion. The forwardmost roller tube 60 functions as a strike-off, initially contacting irregularly shaped mounds of green concrete on the raw slab 55 as the machine 50 is propelled over the forms by driven roller tubes 61 and 62. The axis of rotation of the strike-off roller tube 60 is preferably one-eighth to one-quarter inch higher than the axis of rotation of the driven tubes 61 and 62, so strike-off tube 60 does not ordinarily contact the forms. Also, the strike-off tube 60 is preferably rotated in a direction opposite to the direction of rotation of tubes 61, 62. Thus as the machine 50 moves over the forms, the initial irregular and rough concrete surface is initially stricken-off by tube 60, and then flattened further and smoothed in response to subsequent contact by driven roller tubes 61 and 62. A front mounted sprayer system 72 (FIGS. 3, 7) directs water against the front-mounted roller strike-off tube 60 for lubrication. Water for sprayer system 72 is supplied by frame-mounted water storage tank 73 (FIGS. 1, 3, 5).

Figure 22:
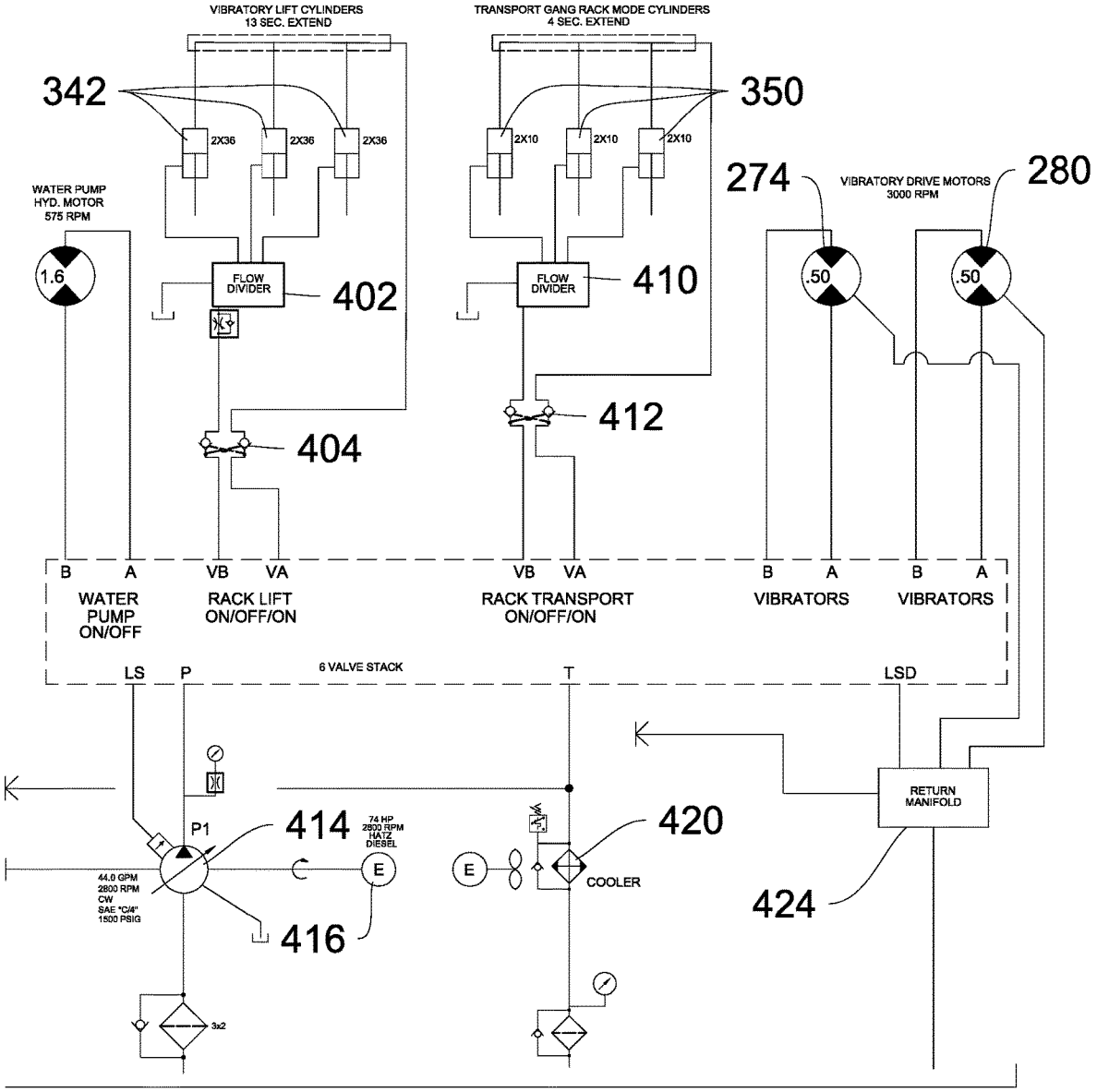

Roller tubes 60-62 are driven through hydraulic motors known in the art, as described in U.S. Pat. No. 5,562,361 referenced above. The schematic is shown in FIG. 22. There is a hollow cylinder 69 extending between the machine ends at the machine rear. Cylinder 69 does not touch the forms, and does not rotate; its purpose is to store water as variable ballast, for counterbalancing the machine 50. During operation the machine 50 periodically pauses to vibrate the wet concrete by deploying its unique gang vibration assembly 56 (i.e., FIGS. 9, 10) described below.

The roller tubes 60, 61, and 62 extend beneath the machine 50 between rigid, generally rectangular end assemblies 75, 76 secured at each end off the machine. The operator end assembly 75 is best seen in FIGS. 2 and 9. These end assemblies comprise a pair of upright side stanchions 77, 78 that extend between an upper, transverse top 79 (i.e., FIGS. 2, 9) and a lower hydraulic drive housing generally designated by the reference numeral 80. A central housing 82 (FIG. 2) at the middle of the larger drive housing 80 supports an upright steering leg cylinder 83 that extends vertically to an upper transverse truss section 84. Cylinder 83 may be activated to project a leg (not shown) into ground contact to slightly lift machine end 68 when irregular masses of concrete tend to misalign the machine. When activating steering leg cylinder 83, the drive rollers 61, 62 may be reversed back and forth to rock the machine and help smooth an irregular mass of concrete at one end of the slab 55.

Figure 9A:
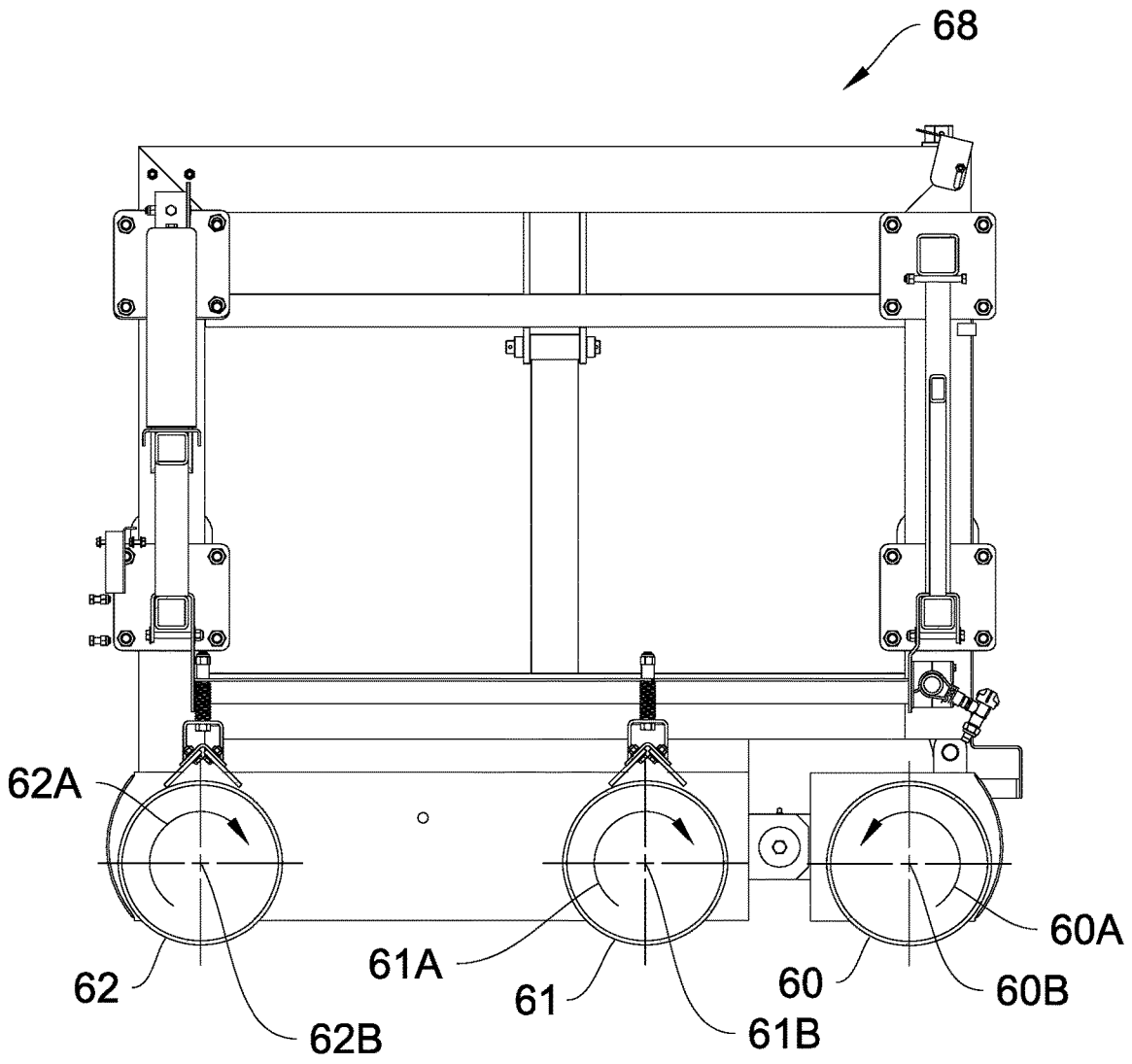
FIG. 9A is a fragmentary, sectional view with portions omitted for clarity derived from line 9A-9A in FIG. 8, that shows the three rollers, their direction of rotation, and their axes of rotation.

The end assemblies 76, 77 support the weight of the machine 50 upon the drive roller tubes 61 and 62. Noting FIG. 7, the opposite end assembly 76 supports a fuel tank 87, and a hydraulic drive motor 91 for the front strike-off roller tube 60. Noting FIG. 6, a drive stub 85 projects outwardly of the hydraulic drive housing 80 for engagement with an end of the rear roller tube 62 (i.e., FIG. 9). Similar stubs from similar hydraulic motors are coupled to roller tube 61 for propulsion, and for the strike-off tube 60. FIG. 9A shows portions of the three roller tubes 60, 61 and 62, with their rotation directions identified by reference numerals 60A, 61A, and 62A, and the axis of rotation of each, respectively designated by the reference numerals 60B, 61B, and 62B.

The machine 50 can be transformed between sixteen and thirty two feet long depending on the number of interconnected modules employed. The length is determined by the number of modular frame sections that are coupled-together to adapt the machine 50 for a particular job. The drawings show a sixteen foot incarnation. One module is a six-foot long, operator's frame end section 90 seen in FIGS. 2 and 4. The end section 90 is connected to an intermediate frame section 96 (FIG. 8) comprising a second module, that is in turn connected to a motor frame section 93 (FIG. 6) comprising a third module. Referencing FIG. 2, there are upper and lower horizontal frame pieces 92, 94 that respectively terminate in an adjustable straightener coupling 100 and a lower clevis coupling 102 that facilitate coupling to the intermediate frame section 96. Frame pieces 92 and 94 have equivalents aligned with them on each of the frame sections that are coupled together to provide the desired machine length. In the illustrated "best mode" example, machine 50 comprises a six foot left frame section 90 supporting a machine operator, a six foot right end frame section 93 (FIG. 6), and a middle connecting section 96 (FIG. 8) of four feet. Importantly, end frame pieces 92, 94 (FIG. 2) are aligned with corresponding pieces on the other frame sections; these form important mounting points for the gang vibration section 56 (FIG. 10) discussed below.

Coupling 100 can be tightened or loosened to adjust the lower frame for sagging, and maintain straightness. At the rear of modular frame section 90 there is an approximately sixteen inch wide platform section 108 (FIG. 4) bounded by a pair of spaced apart, vertically upright stanchions 110 and 112 connected by upper and lower horizontal rails 114 and 115 respectively (FIGS. 2, 4). The generally cubicle operator console 116 comprises an upper control surface 118 upon which a variety of electrical switches and controls are mounted for operating the "electric over hydraulic" control system of the invention. As explained hereinafter, the control console is electric to reduce the footage of expensive hydraulic hoses otherwise needed to plumb the machine 50. The various hydraulic flow lines are controlled by electric solenoid and the like, as illustrated schematically hereinafter. As can be seen from FIG. 2, the frame end section 90 provides a convenient place for the operator to stand proximate the control console 116 so he or she can easily see the forms, the raw concrete, and the machine parts and details. From the operators position, which is substantially surrounded by the machine structure, visibility is enhanced by a pair of spaced apart mirrors 117 and 119 (i.e. FIG. 5).

The motor end frame module section 93 (FIG. 6) comprises a generally cubicle housing 120 for a conventional internal combustion (i.e., diesel) motor and hydraulic pumps. It supports an intake breather 121. A another platform section 108B (FIG. 6) is bounded by vertically upright stanchions 126 and 128 connected by upper and lower horizontal rails 132 and 134. A cooling fan assembly 138 comprising a cooling fan 140 and fluid heat exchanger 141 are disposed proximate a control valve housing 144 that encloses a plurality of electrically activate hydraulic valves and solenoids 146.

The gang vibration assembly 56 (FIG. 10) is adapted to retract when desired for reducing the dimensions of the machine 50 by moving into a nested position adjacent the front of the machine. It includes at least one vibrator rack assembly coupled in front and a plurality of rack lift assemblies that hydraulically actuate the vibrator rack assemblies. The gang vibration 56 assembly can be hydraulically moved through compound movements. For example, it can be moved between an operational position, wherein individual vibrators can be vertically lowered into wet concrete when the rollers are stopped, and retracted position moved upwardly and inwardly. These vibrators can then be raised vertically and retracted rearwardly when the rollers are activated to move the machine. With the vibrators raised, they clear the rebar in the concrete below, and interference or deleterious contact is avoided. Moreover, then the vibrators are raised, the gang vibration assemblies can be retracted to dispose the machine 50 in an enhanced clearance, shipping or stowage configuration.

Figure 10:
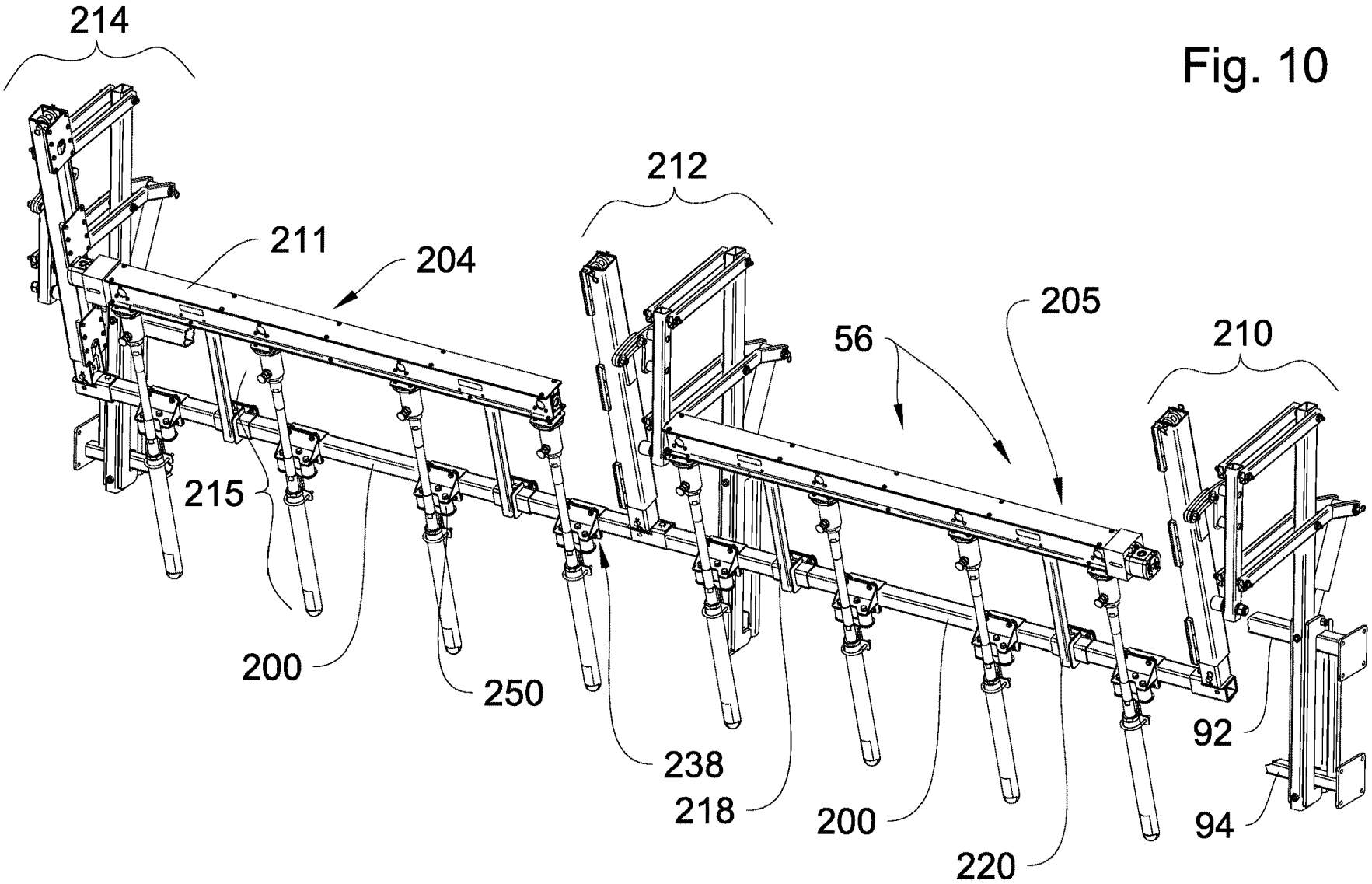
FIG. 10 is an enlarged, frontal isometric view of the preferred gang vibration assembly, showing it detached from the finishing machine.
Figure 11:
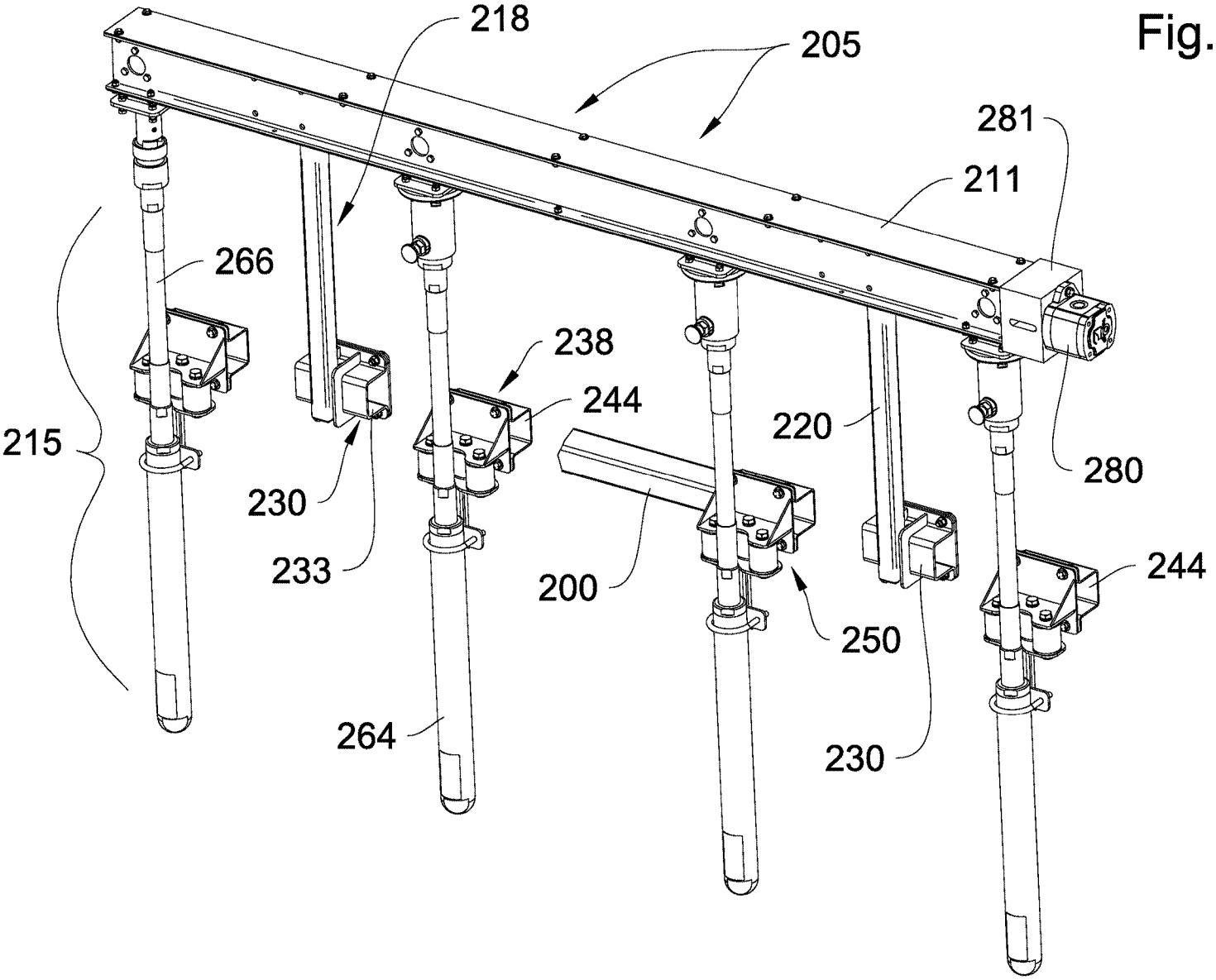
FIG. 11 is a, frontal isometric view of the preferred left vibration rack, showing it removed from the vibration gang assembly.

Referring FIG. 10, the gang vibration assembly 56 is adapted to be coupled to portions of the machine frame for support. The length of the gang vibrations assembly is variable; added sections of vibrators etc. can be added as desired for different sizes of machines, and different widths of concrete pours being treated. In the illustrated mode, gang vibration assembly 56 comprises a rigid, elongated, horizontally oriented lifting bar 200 that extends substantially horizontally between opposite ends of the machine 50 at its front. As illustrated, the lifting bar 200 supports a number of spaced-apart and substantially parallel vibrator rack assemblies whose number depends upon the desired length of the machine. As illustrated with the sixteen-foot embodiment of the invention, there is a right vibrator rack assembly 204 (i.e., FIGS. 10, 14) and a companion left vibrator rack assembly 205 (i.e., FIGS. 10, 12). Each of the vibrator rack assemblies comprises a plurality of spaced apart, generally vertically oriented vibrators detailed below that are adapted to be selectively immersed within wet concrete during operation. The number of vibrators depends upon the desired dimensions of the finishing machine 50, which in the illustrated embodiment is sixteen feet. The vibrator rack assemblies 204, 205 are selectively deployed or positioned by a plurality of spaced apart gang lift assemblies 210, 212, and 214 that execute compound movements, preferably through a parallelogram linkage described below. The number of gang lift assemblies depends upon the desired machine dimensions. As illustrated (i.e., FIGS. 10, 16), the left side gang lift assembly 210 is disposed at the front left of the machine 50, the right side gang lift assembly 214 is disposed at the machine front right, and the middle gang lift assembly 212 is disposed approximately at the center of the gang vibration assembly 56 on lifting bar 200 between the right vibrator rack assembly 204 and the left vibrator rack assembly 205.

Figure 12:
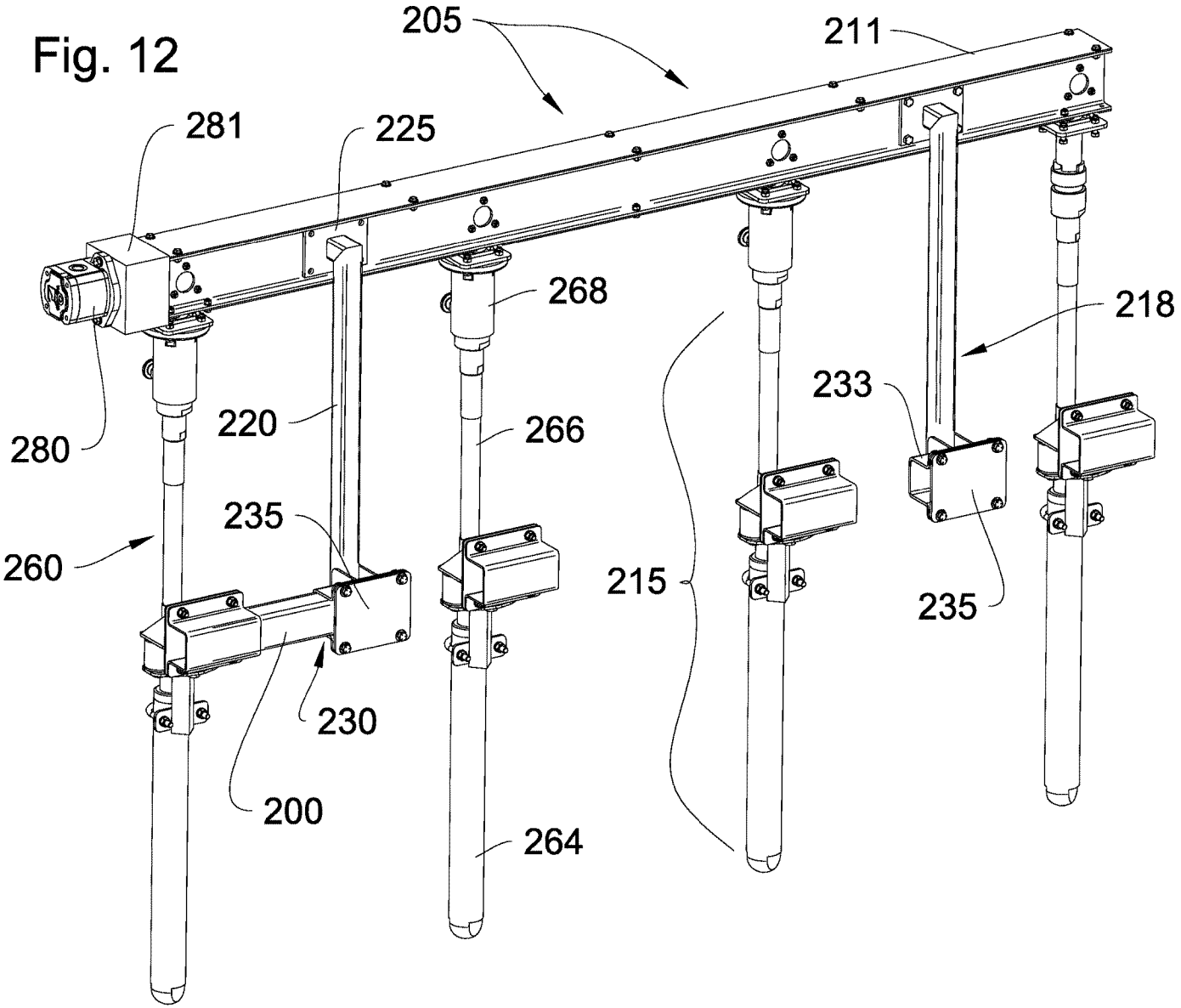
FIG. 12 is a rear isometric view of the preferred left vibration rack, showing it removed from the vibration gang assembly.
Figure 13:
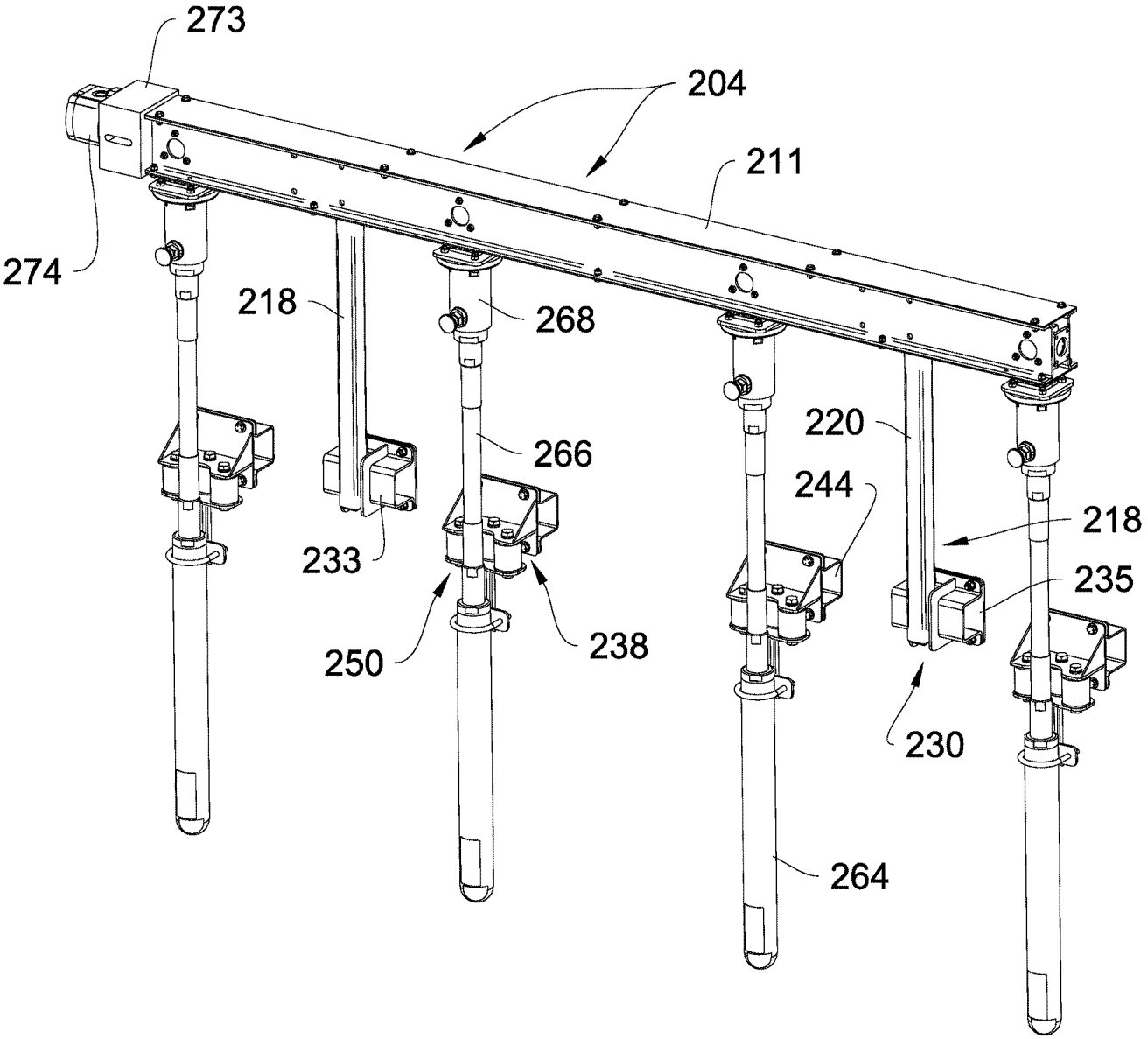
FIG. 13 is a frontal isometric view of the preferred right vibration rack, showing it removed from the vibration gang assembly.
Figure 14:
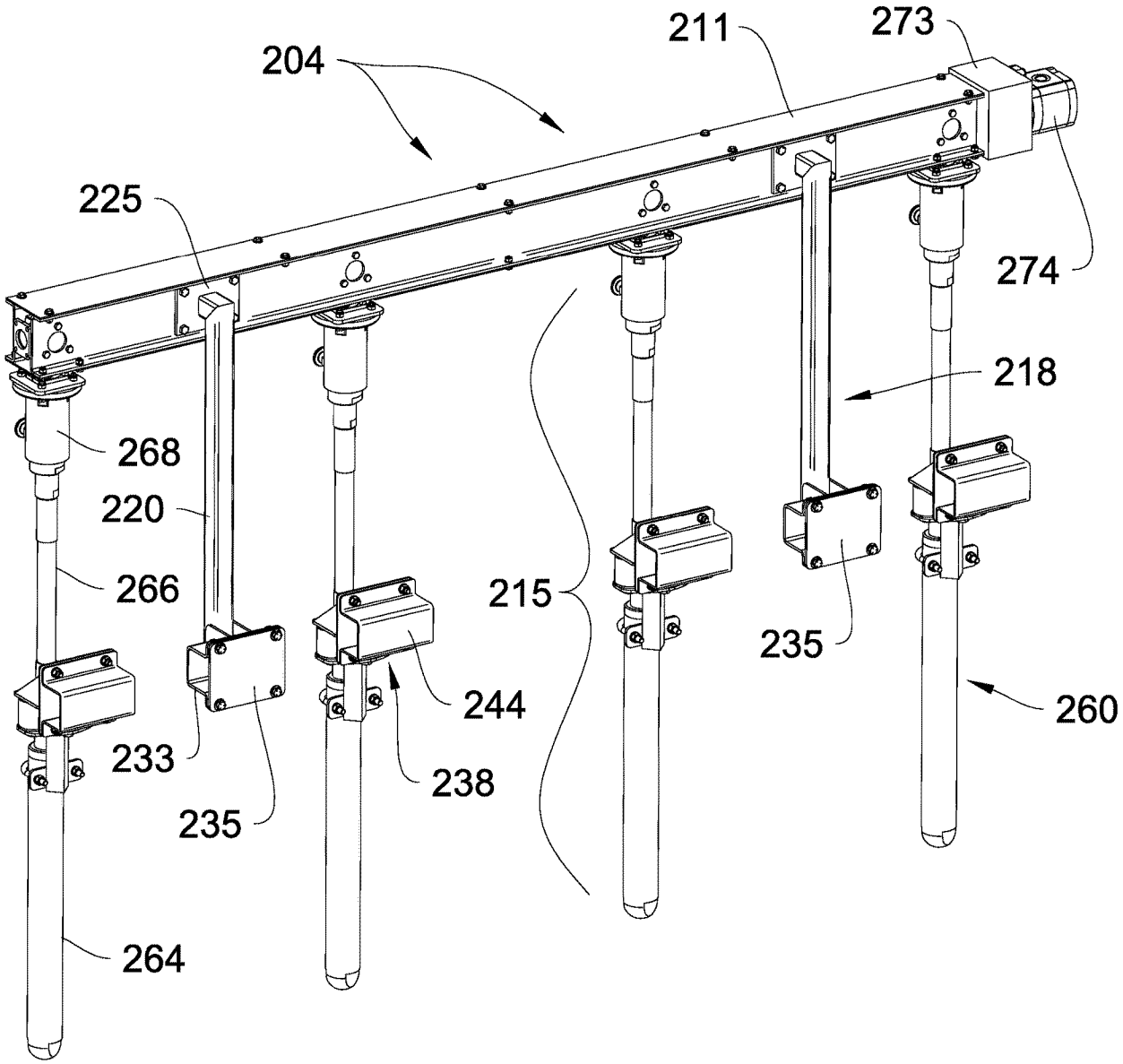
FIG. 14 is a rear isometric view of the preferred right vibration rack, showing it removed from the vibration gang assembly.

Referencing FIGS. 11-14, the left vibration rack assembly 205 and the right vibration rack assembly 204 are very similar modules, and they comprise substantial mirror images of one another. While there are two vibration rack assemblies in this embodiment, larger finishing machines will require more. Each vibration rack assembly module 204, 205 comprises a rigid, upper, transverse vibrator suspension header 211 that supports a plurality of spaced apart, lower, hanging vibrator units 215. In this embodiment each of the vibration rack assemblies comprises four vibrator units 215, but varying machine sizes will necessitate more or less vibrators or more or less vibrator rack modules. There are a pair of vertically oriented, spaced apart supports 218, 220 disposed between pairs of adjacent vibrator units 215 (i.e., FIG. 14). Each support 218, 220 is secured at its top to vibrator suspension header 211 by a bracket 225 (FIGS. 12, 14). Each support 218, 220 terminates at its bottom in a lower bracket 230 (FIG. 13) adapted to be penetrated by transverse lifting bar 200 (i.e., FIG. 10). Each bracket 230 comprises a channel portion 233 (i.e., FIG. 14) and a companion back plate 235 (FIG. 12). Similarly, each vibrator unit 215 is provided with a bracket 238 (i.e., FIGS. 10, 11) comprising a channel 244 (FIG. 11, 13) adapted to be penetrated by lifting bar 200, and a forward cradle section 250 (FIG. 11) for yieldably cradling and embracing the generally cylindrical body of the individual vibrator units 215 to dynamically promote a generally vertical orientation. Each vibrator is a flexible, pendulous type sold by the Vibtec company in the UK. Each vibrator 260 (FIG. 12) has a lower, cylindrical pendulous portion 264, an elongated hose portion 266 (FIGS. 11, 13), and an upper coupling 268 that connects to gearing within vibrator suspension header 211. As seen in FIG. 10, for example, each gang lift assembly such as assembly 210 connects to horizontal lifting bar 200. Thus vertical displacements of the lifting bar 200 correspondingly displace the suspension header 211 to vertically displace the individual vibrator units 215, inserting them within or withdrawing them from the concrete.

Figure 15:
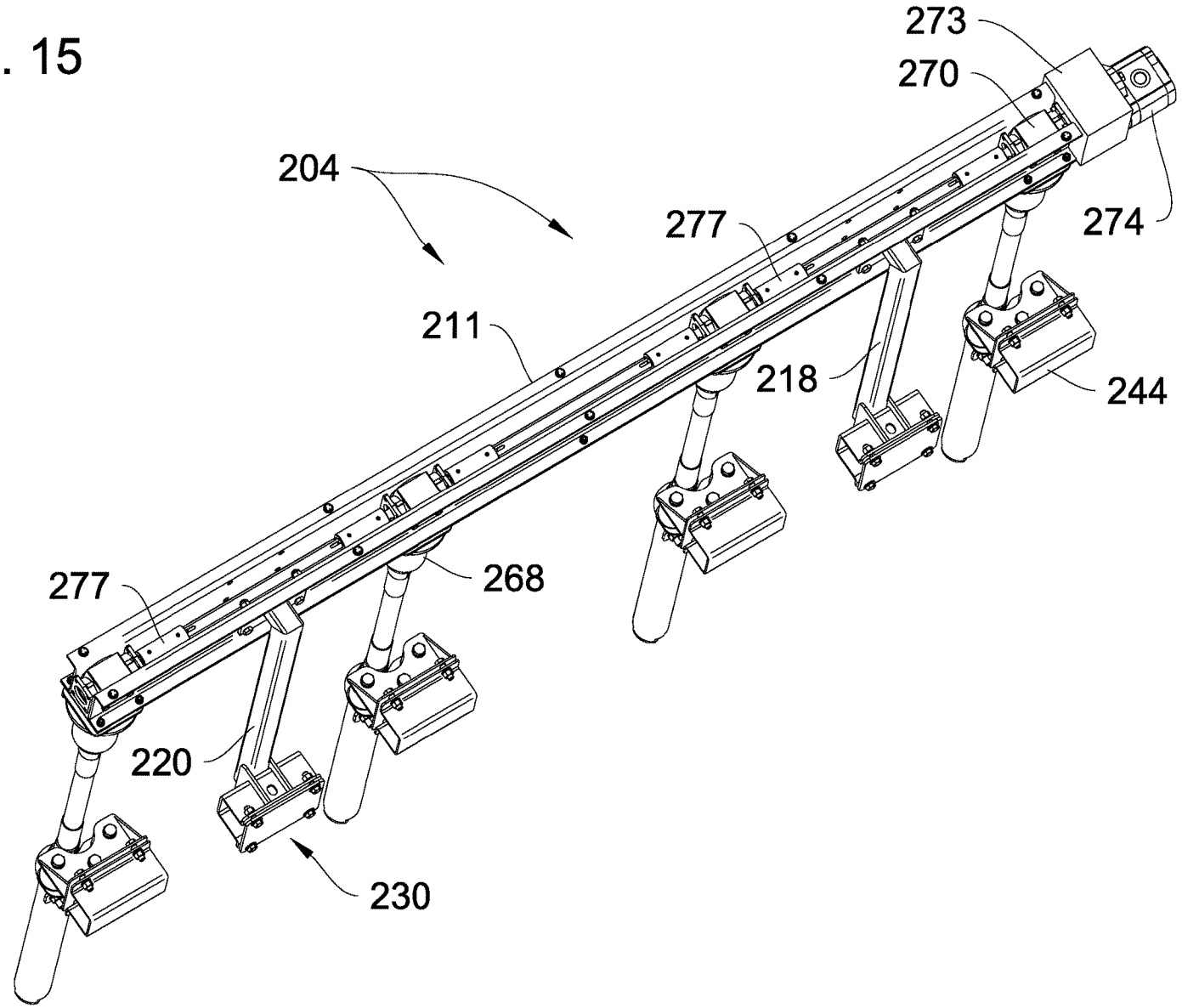
FIG. 15 is a top isometric view of the right vibration rack assembly, showing the header interior.

Referencing FIGS. 13-15, the hanging vibrators 260 are each part of a separate vibrator unit 215, each of which hangs down from vibrator suspension header 211. Each vibrator unit 215 has an upper coupling 268 that is connected through header 211 to a small, ninety-degree gearbox 270 disposed within the interior of the header 211. The hydraulic drive motor 274 (FIG. 14) associated with the right rack assembly 204 (FIG. 15) drives the gearboxes 270 that are interconnected by links 277 within vibrator suspension header 211 that interconnect gearboxes 270. Drive motor 274 is coupled to header 211 via an adaptor 273 (FIG. 14). The left vibrator rack assembly 205 (i.e., FIG. 12) similarly includes a hydraulic motor 280 mounted to vibrator suspension header 211 via an adaptor 281 for operating its vibrator units 215.

Figure 16:
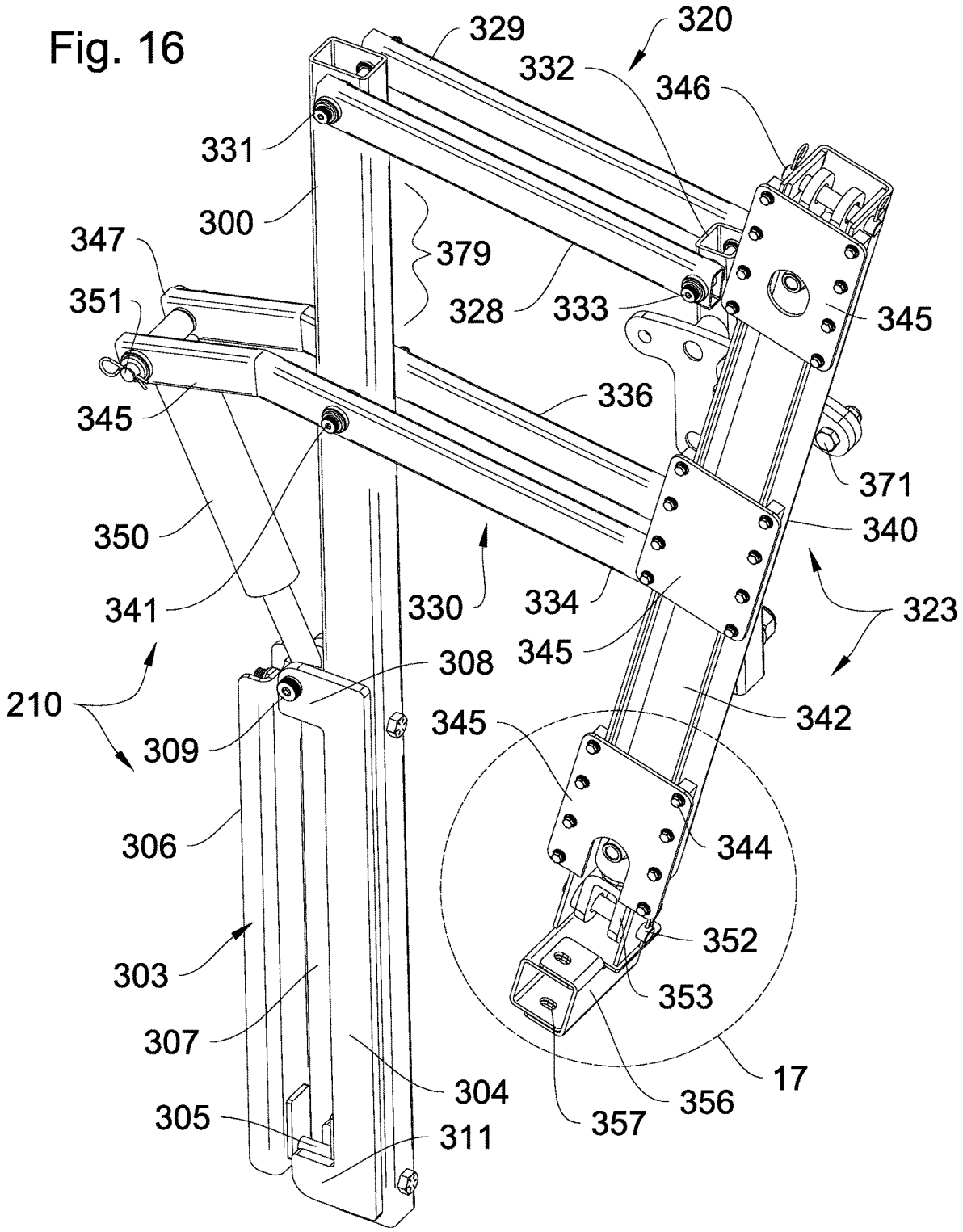
FIG. 16 is an enlarged isometric view of a preferred gang lift linkage, showing it in a retracted transportation mode.

With joint reference directed now to FIGS. 16-20, each of the preferred gang lift assemblies 210, 212, 214 (FIG. 10) are substantially identical. The gang lift assemblies preferably deploy the vibrators outwardly and downwardly, or retract them upwardly and inwardly; they preferably include a parallelogram linkage arrangement for stability and strength. As seen in FIG. 16, for example, the gang lift assembly 210 comprises an elongated, vertically oriented tube stanchion 300 that has an elongated securement bracket 303 at its bottom for connection to the machine frame. Bracket 303 comprises an elongated pivot plate 304 that terminates in upper and lower offsets 308 and 311 respectively. An elongated, complementary channel cover 306 (FIG. 16) pivotally connects to bracket offset 308 at its top with fastener 309, that also pivotally secures the hydraulic cylinder 350. Cover 306 adjustably connects at its bottom to bracket offset 311 and stanchion 300 with a fastener 305 (FIG. 16) that may be tightened to mount the gang lift assembly, captivating the transverse frame pieces 92 and 94 (i.e., FIG. 2) sandwiched within space 307 to securely mount the gang vibration assembly 210 at the front of the machine 50.

Figure 18:
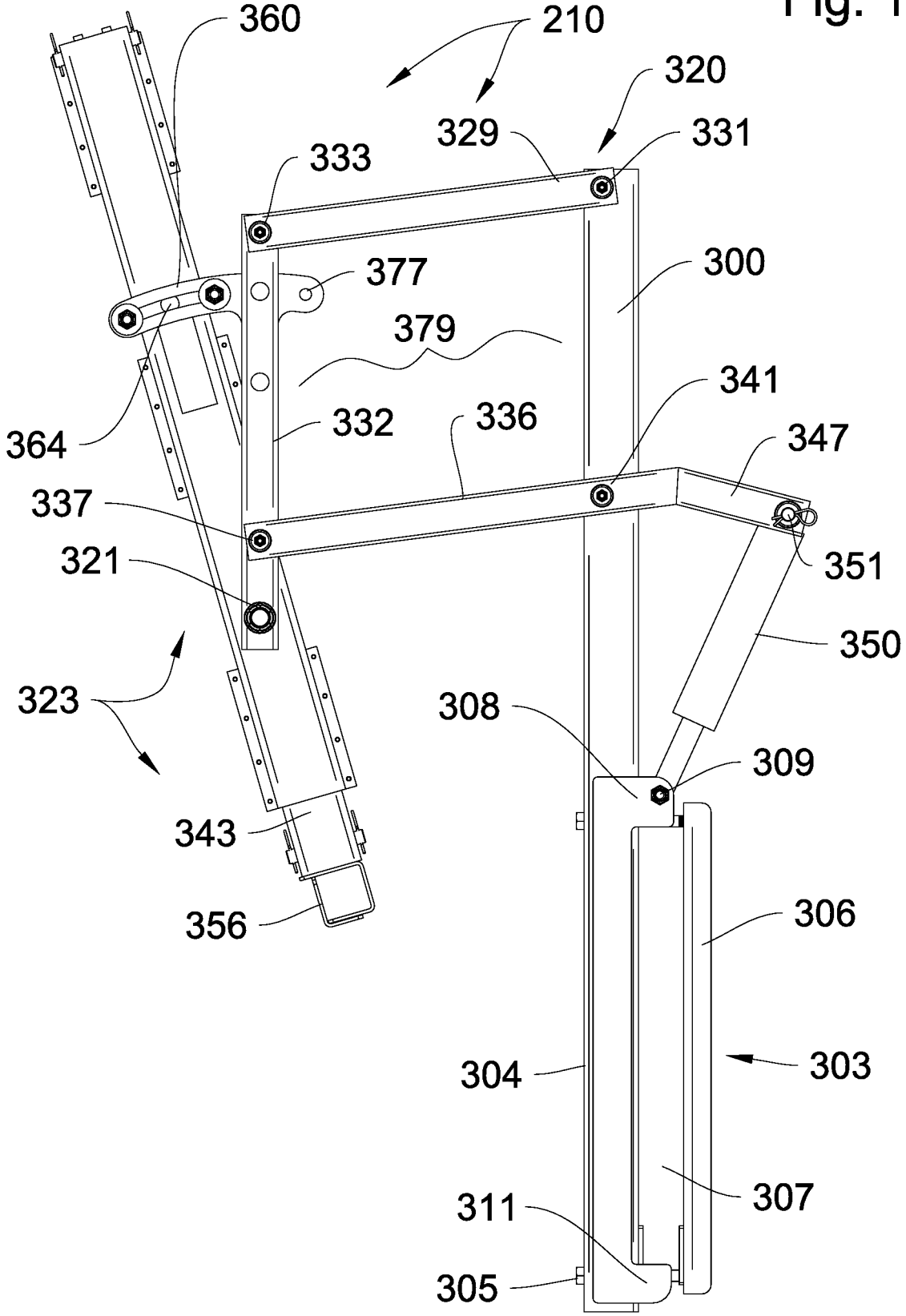
FIG. 18 is a diagrammatic end view of the gang lift assembly showing part placement and configuration immediately before deploying the vibrators.
Figure 19:
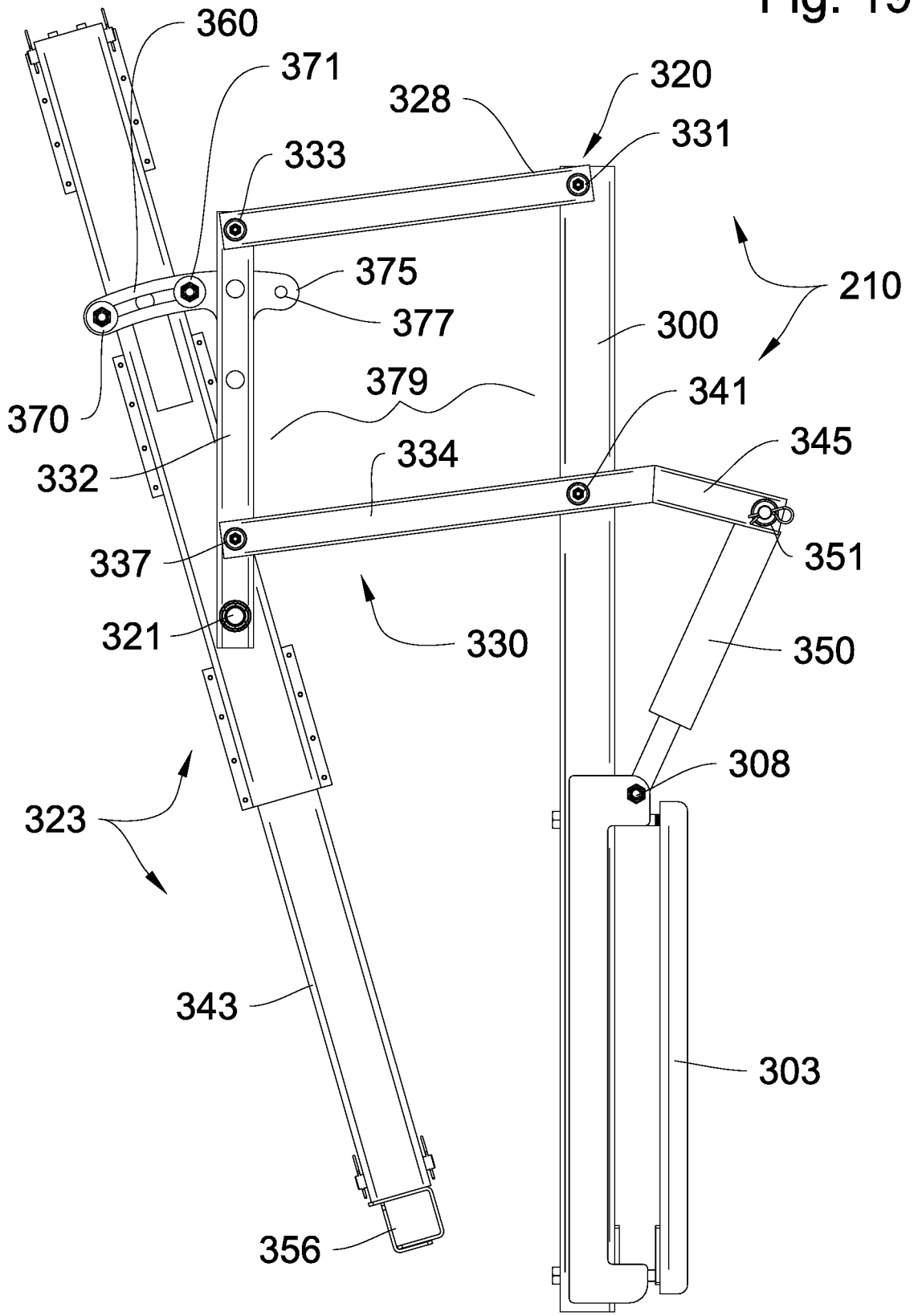
FIG. 19 is a diagrammatic end view of the gang lift assembly showing part configuration during concrete vibrating.
Figure 20:
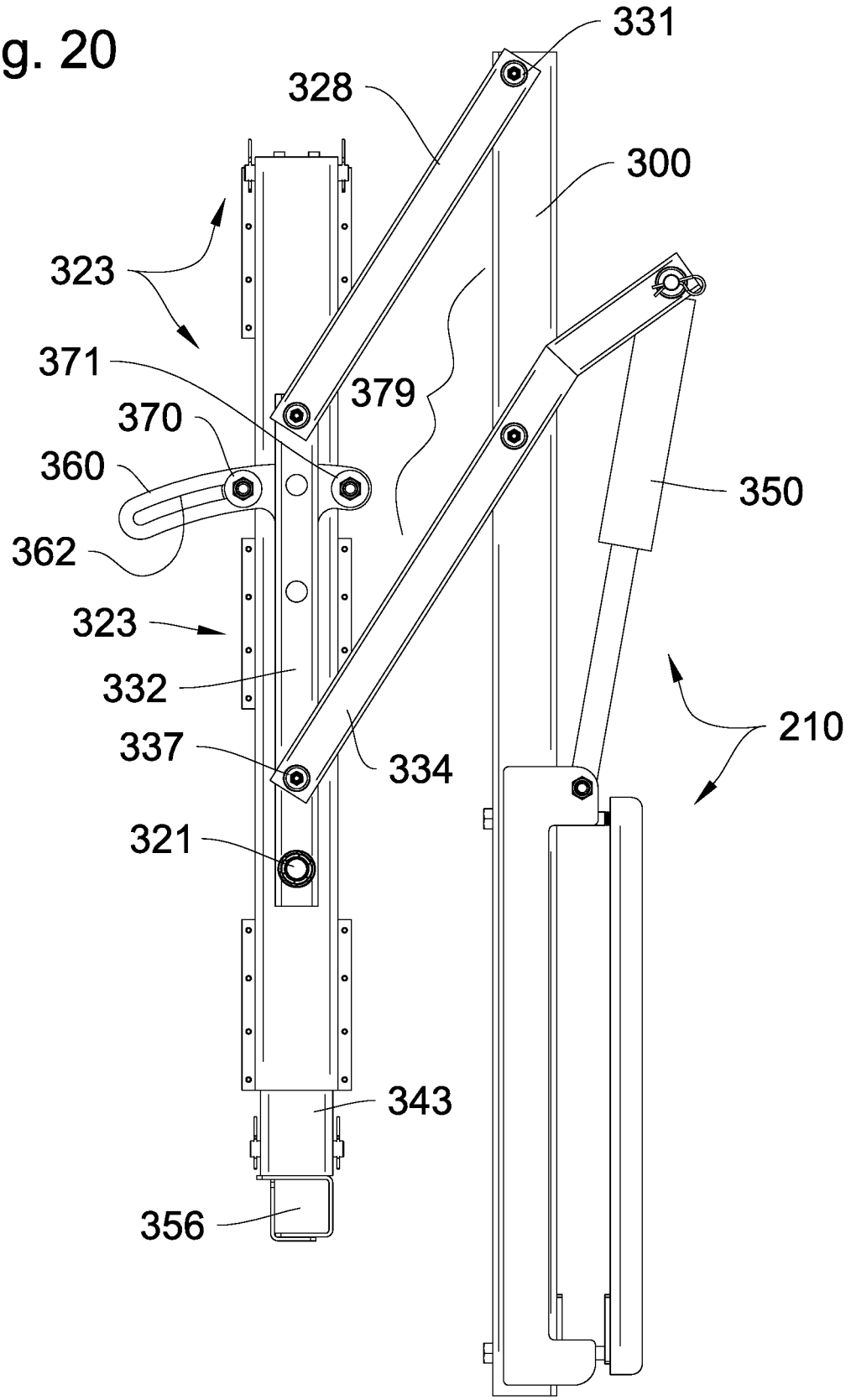
FIG. 20 is a diagrammatic end view of the gang lift assembly in the retracted mode.

Stanchion 300 (FIG. 16) has an upper linkage assembly 320 (FIGS. 16, 18) pivotally disposed at its top that interconnects with an adjacent elevator 323. The upper linkage assembly 320 comprises a pair of parallel, upper linkage bars 328 and 329 (FIG. 16) pivoted at their inner ends at point 331 to the top of stanchion 300 and at their opposite ends to a vertical strut 332 at pivot 333. A lower linkage assembly 330 is formed with a spaced apart pair of lower, parallel linkage bars 334 and 336 pivoted at 341 to a midpoint of stanchion 300. Bars 334, 336 terminate in integral, slightly inclined feet 345 and 347 (FIG. 16) that pivotally captivate an upper end of a transport/retraction cylinder 350 at pivot point 351 (i.e., FIGS. 17-20), whose lower shaft end pivots at 352 to offset 308. The linkage bars 334 and 336 are pivoted at 337 to rigid strut 332 (FIG. 18), which is in turn pivoted to the elevator 323 at 321 (FIGS. 18-20). A parallelogram linkage, that executes compound movements of the vibrators, generally designated by the reference numeral 379 (FIG. 18, 20) thus formed by the combination of upper linkage bars 328 and 329, the lower linkage bars 334, 336, strut 332, and the upper portion of stanchion 300. The transport/retraction cylinder 350 thus deploys or retracts the gang lift assembly by activating the parallelogram linkage, and the vibrators disposed thereon, within or without the concrete being treated.

Figure 17:
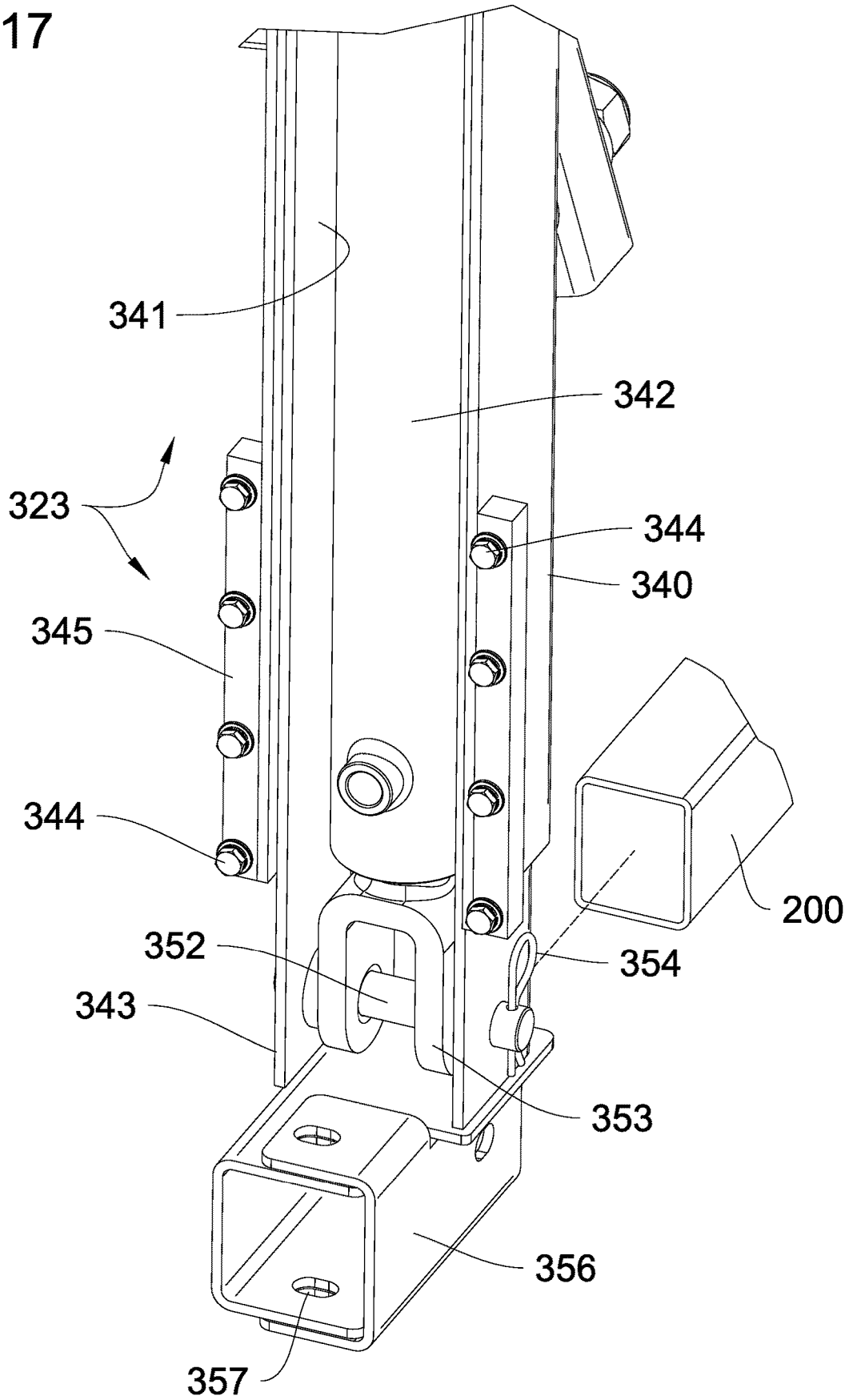
FIG. 17 is an enlarged, partially exploded view of the lower elevator derived from circled region 17 in FIG. 16, with portions omitted for clarity.

Referencing FIGS. 16 and 17, the elevator 323 comprises an elongated channel casing 340 that interiorly houses a somewhat smaller and concentric extension 343 (FIG. 20) that is telescoped within casing 340. An elongated hydraulic lift cylinder 342 displaces the extension 343, to expand the elevator 323 and force the vibrators described previously into the wet concrete below. Lift cylinder 342 can function independently of transport/retraction cylinder 350. The vibrators position and orientation is thus determined by the combination of the parallelogram linkage 379 and the lift cylinder 342. Elevator casing 340 and extension 343 therewithin are partially shrouded by three spaced apart pairs of covers 345 (FIG. 16) that protect the interior, and which are held together with periodic fasteners 344 (FIGS. 16, 17). The elevator lift cylinder 342 terminates at its top within casing 340 and is pivotally retained by a pin 346 (FIG. 16). The ram portion at the bottom of the elevator lift cylinder 342 terminates in a clevis 353 (FIG. 17) that is secured by pivot pin 352 and locked by pin 354 to the bottom of telescopic extension 343. A lower transverse channel 356 secured to the bottom of extension 343 is adapted to be coupled to the frame bar 200 (FIG. 10) and orifices 357 are provided for securement.

Referencing FIGS. 18-20, the linkage strut 332 is pivoted at 337 to lower linkage bar 334, and strut 332 is pivoted to the elevator 323 at 321. An arcuate guide 360 (FIG. 20) secured to strut 332 includes a curved, follower slot 362 in which a follower fastener 370 projecting from the elevator 323 rides for tracking. When the configuration of FIG. 18 is reached, fasteners 370 and 371 should be tightened to secure the apparatus during setup. Also, it is preferred to start the pendulous vibrators when they are inclined as in FIG. 18. Afterwards the elevator 323 is activated, to force the elevator extension 343 downwardly (i.e. FIG. 19) so the vibrators enter the concrete for vibration. At this time of course the drive rollers will not be activated and the machine 50 will assume a temporary stationary position over the concrete for vigorously vibrating the green concrete. Machine travel during the latter vibration during this time interval is suspended to prevent destructive physical contact between the vibrators immersed within the concrete and the rebar within the slab.

FIG. 20 shows the partially retracted mode. In this mode the elevator cylinder 342 (FIG. 16) has withdrawn the extension 343 back into the elevator 323, drawing the vibrators out of the concrete. Also, retraction cylinder 350 has been activated and extended such that upper and lower linkage bars 328 and 334 respectively are angled as in FIG. 20, which draws the apparatus closer to the body of the machine 50 to reduce the overall outside dimensions. From FIG. 19, for example, it will be noticed that arcuate guide 360 has an inner ear 375 that has an orifice 377 (FIG. 18.) Prior to retraction, fastener 371 (FIG. 19) should be removed, allowing clearance, and once the position of FIG. 20 is reached, fastener 371 can be tightened within orifice 377 (FIG. 18) to secure the apparatus in the retracted configuration of FIG. 20.

Figure 21:
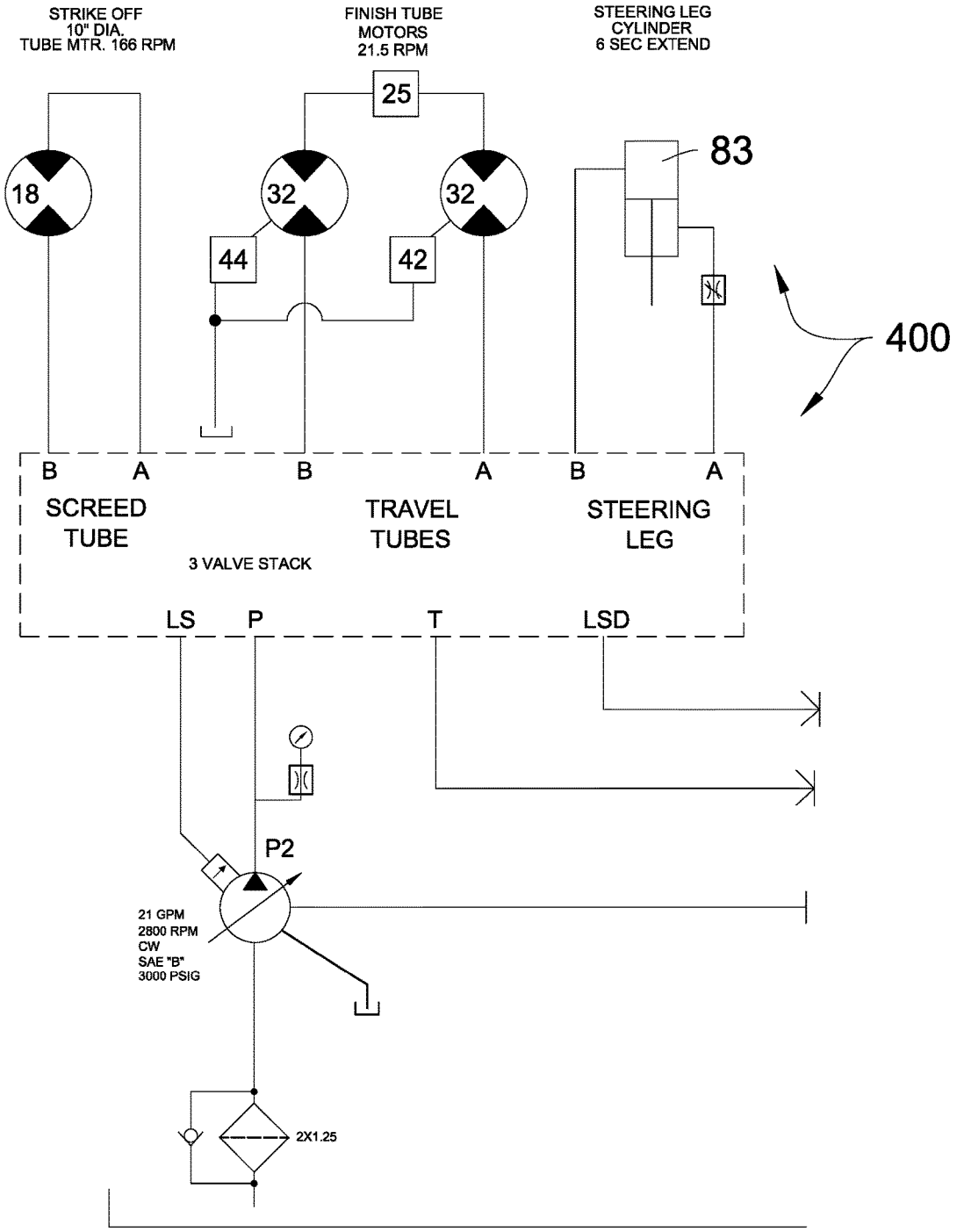
FIG. 21 is an abbreviated, partial schematic diagram of the hydraulic apparatus for controlling the gang vibration assembly, with portions thereof known in the art omitted for brevity; and, FIG. 22 is an abbreviated, partial schematic diagram of the hydraulic roller tube control apparatus.

Referencing FIGS. 21 and 22, the vibrator gang lift apparatus is controlled by a circuit 400. The lift cylinders 342 are connected to a flow divider 402 and controlled by a solenoid controlled hydraulic valve 404. Similarly retraction cylinders 350 are coupled through a flow divider 410 via another solenoid controlled hydraulic valve 412. The vibrators are activated by hydraulic motors 274, and 280 that can be ganged together when multiple vibrator rack sections are employed. The master hydraulic pump has been designated by the reference numeral 414. It is driven by a Hatz-brand diesel engine generally designated by reference numeral 416. A cooler 420 and return manifold 424 are included.

As appreciated from the foregoing discussion and a review of FIGS. 18-20, by the movement of the parallelogram linkage thus formed, the vibrators can be moved inwardly and retracted towards the machine front, and when deployed, they are moved forwardly while maintaining a substantially perpendicular orientation.

From the foregoing, it will be seen that this invention is one well adapted to obtain all the ends and objects herein set forth, together with other advantages which are inherent to the structure.

It will be understood that certain features and subcombinations are of utility and may be employed without reference to other features and subcombinations.

As many possible embodiments may be made of the invention without departing from the scope thereof, it is to be understood that all matter herein set forth or shown in the accompanying drawings is to be interpreted as illustrative and not in a limiting sense.

What is claimed is:

1. A self propelled concrete finishing machine with a front and a rear and a pair of ends, the machine comprising:
   - at least one elongated, driven roller tube for propelling said machine during concrete finishing;
   - at least one concrete strike-off roller tube disposed at the front of said machine for initially contacting concrete and striking it off during machine propulsion, said strike-off roller tube disposed in parallel, spaced relation relative to the at least one driven roller tube;
   - at least one retractable vibrator rack assembly coupled to the machine proximate the machine front for selectively contacting and vibrating concrete during machine operation;
   - a compound movement linkage for moving each vibrator rack assembly either downwardly and forwardly into contact with the concrete or upwardly out of contact with concrete and rearwardly to a position nested against the machine front for reducing the dimensions of the machine when finishing is complete, the retractable gang vibration assembly comprising a plurality of spaced apart, generally vertically oriented hanging vibrator units adapted to be immersed in concrete or withdrawn therefrom;
   - wherein the vibrator rack assembly comprises a rigid, upper, transverse vibrator suspension header that supports the vibrator units and drives them with gears disposed within said header; and,
   - at least one lift assembly for lifting and lowering said at least one vibrator rack assembly to vertically displace the vibrator units into the concrete surface or to withdraw them from the concrete surface.

2. The machine as defined in claim 1 wherein the at least one lift assembly for lifting and lowering said at least one vibrator rack assembly comprises an elongated, transverse generally horizontally disposed lifting bar, and wherein each hanging vibrator assembly is coupled to said lifting bar whereby vertical displacements of the lifting bar correspondingly displace the vibrator rack assembly, thereby inserting vibrator units within the concrete surface or withdrawing them from the concrete surface.

3. The machine as defined in claim 2 wherein the compound movement linkage comprises a parallelogram linkage.

4. The machine as defined in claim 3 further comprising a transport/retraction cylinder for actuating the parallelogram linkage for deploying a gang lift assembly outwardly and downwardly, or for retracting a gang lift assembly upwardly and inwardly to nest it towards the machine front.

5. The machine as defined in claim 4 wherein the parallelogram linkage comprises an elevator interiorly housing an extension telescoped therewithin, and a lift cylinder for selectively displacing the extension to expand or contract the elevator to force the vibrator units into or out of the wet concrete below independently of the transport retraction cylinder.

6. The machine as defined in claim 2 wherein each vibrator unit comprises a channel penetrated by said lifting bar and the machine comprises cradles for yieldably cradling and embracing individual vibrator units to dynamically promote a generally vertical vibrator orientation.

7. The machine as defined in claim 6 wherein each vibrator unit comprises a flexible, pendulous type vibrator comprising a lower, cylindrical pendulous portion, and an elongated hose portion that connects to drive gearing.

8. A roller tube concrete finishing machine with a front and a frame having spaced apart ends, the machine comprising:

at least one elongated, driven roller tube disposed beneath said frame for propelling said machine during concrete finishing, said at least one roller tube extending between spaced apart frame ends and riding on forms parallel with a concrete surface to be finished;

at least one concrete strike-off roller tube disposed at the front of said machine for initially contacting concrete and striking it off during machine propulsion;

at least one retractable vibrator unit mounted at the front of said frame for selectively vibrating concrete, the retractable vibrator assembly comprising a plurality of spaced apart, individual vibrator units adapted to be immersed in concrete or withdrawn therefrom;

a parallelogram linkage for deploying the vibrator units by moving them forwardly and downwardly relative to the machine for contacting and vibrating concrete in an operation mode and for retracting the vibrator units upwardly out of contact with concrete and rearwardly to a transport position nested against the frame for reducing the dimensions of the machine;

at least one cylinder for actuating the parallelogram linkage;

wherein each retractable vibrator rack assembly comprises a rigid, upper, transverse vibrator suspension header that connects to and drives a plurality of individual downwardly hanging vibrator units, and an elongated, generally horizontally disposed lifting bar that displaces the suspension header; and, wherein the parallelogram linkage comprises an elevator interiorly housing an extension telescoped therewithin, and a lift cylinder for selectively displacing the extension to expand or contract the elevator to force the individual vibrator units into or out of the wet concrete below independently of the transport retraction cylinder.

9. The machine as defined in claim 8 wherein each individual vibrator unit comprises a channel penetrated by said lifting bar and the machine comprises cradles for yieldably cradling and embracing individual vibrator units to dynamically promote a generally vertical vibrator orientation.

10. A roller tube concrete finishing machine comprising:

a pair of driven roller tubes disposed beneath said machine for propelling said machine during concrete finishing, said roller tubes extending between spaced apart frame ends and riding on forms parallel with a concrete surface to be finished;

at least one concrete strike-off roller tube disposed at the front of said machine for initially contacting concrete and striking off concrete during machine propulsion;

a retractable gang vibrator assembly mounted at the front of said frame, the retractable gang vibrator assembly comprising a plurality of generally vertically oriented vibrator units for selectively vibrating concrete, the individual vibrator units adapted to be immersed in concrete or withdrawn therefrom;

a parallelogram linkage for deploying the gang vibrator assembly by moving it forwardly and downwardly relative to the machine for vibrating concrete and for retracting the gang vibrator assembly upwardly out of contact with concrete and rearwardly to a transport position nested against the frame;

wherein the retractable gang vibrator assembly comprises a rigid, upper, transverse vibrator suspension header that connects to and drives the individual downwardly hanging vibrator units and an elongated, generally horizontally disposed lifting bar that displaces the suspension header;

a cylinder for actuating the parallelogram linkage; and, wherein the parallelogram linkage comprises an elevator interiorly housing an extension telescoped therewithin, and a lift cylinder for selectively displacing the extension to expand or contract the elevator to force the individual vibrators units into or out of the wet concrete below independently of the transport retraction cylinder.

11. The machine as defined in claim 10 further comprising cradles for yieldably cradling and embracing corresponding individual vibrator units to dynamically promote a generally vertical vibrator orientation.

* * * * *